US006073555A

United States Patent [19]

Billington, III

[11] Patent Number: 6,073,555

[45] Date of Patent: Jun. 13, 2000

[54] PRESS ARM FOR SCREEN PRINTING EQUIPMENT

[75] Inventor: Charles J. Billington, III, Modesto, Calif.

[73] Assignee: Billington Welding and Manufacturing, Inc., Modesto, Calif.

[21] Appl. No.: 09/167,953

[22] Filed: Oct. 6, 1998

[51] Int. Cl.[7] ..... B41F 15/36

[52] U.S. Cl. ..... 101/127.1; 101/DIG. 36

[58] Field of Search ..... 101/114, 126, 101/127, 127.1, 128, 128.1, 129, DIG. 36

[56] References Cited

U.S. PATENT DOCUMENTS

| | | | |
|---|---|---|---|
| 4,338,860 | 7/1982 | Hamu | 101/126 |
| 4,974,508 | 12/1990 | Andersen et al. | 101/115 |
| 5,315,929 | 5/1994 | Sundqvist | 101/127.1 |
| 5,445,075 | 8/1995 | Panipinto | 101/127.1 |
| 5,619,919 | 4/1997 | Karlyn et al. | 101/123 |
| 5,771,801 | 6/1998 | Newman et al. | 101/127.1 |

OTHER PUBLICATIONS advertisement by CAPS Convex Apparel Printing System, Printwear Magazine Apr. 1997.

advertisement by Workhorse Products Screen Printing Systems, Printwear Magazine Apr. 1997.

Brochure by Hopkins/BWM for screen printing equipment, Modesto, CA.

*Primary Examiner*—Ren Yan

*Attorney, Agent, or Firm*—Flehr Hohbach Test Albritton & Herbert LLP

[57] ABSTRACT

A press arm (110) including a mounting plate (112) and a clamp support (116) for support of a print screen, and one or more independently mounted intermediate components (134, 136, 180, 184, 214, 216, and 228) that provide for independent adjustment of clamp support (116) in each of six ways: lateral adjustment in the X-, Y- and Z-axis, and angular adjustment in the X-Y plane, the X-Z plane and the Y-Z plane. Various threaded adjustment bolts and releasable clamps are provided for making each of the independent adjustments.

25 Claims, 21 Drawing Sheets

PRESS ARM FOR SCREEN PRINTING EQUIPMENT

TECHNICAL FIELD

The present invention relates to screen printing equipment and, more particularly, to a press arm assembly for adjusting the position of a screen for printing an article such as for example T-shirts and other types of clothing.

BACKGROUND ART

Screen printing of T-shirts and other articles of clothing and the like is more and more requiring precise positioning of the pattern screen over the article to be printed due to the greater resolution of screens and the attendant need to achieve close tolerance, accurate alignment of each high tension color screen for optimum color and resolution and to do so repeatedly to produce consistent prints.

Hopkins/BWM of Modesto, Calif., USA provides screen printing equipment having printing heads that are 6-way adjustable, including adjustability in 3 axis as well as tilt control, level control, and alignment for proper off-contact. The present invention improves upon Hopkins 6-way adjustable press arm, as discussed herein.

DISCLOSURE OF INVENTION

Briefly described, the press arm of the present invention includes a clamp support adjustably secured to a mounting component, with the clamp support being adjustable relative to the mounting component both laterally in the X-, Y-, and Z-axis and angularly in the X-Y, Y-Z, and X-Z planes, and with one of the Y-axis and X-Y plane adjustments, the Z-axis and X-Z plane adjustments, and the X-axis and Y-axis adjustments being independent of the other.

Independent adjustment where the Y-axis and X-Y plane adjustments are independent from each other, that is a Y-axis adjustment does not affect the angular X-Y plane adjustment, provides a simpler adjustment procedure that can eliminate the need for repeated re-adjustment that is inherent where two or more adjustment mechanisms are inter-related. Independent adjustment between Z-axis and X-Z plane adjustments achieves the same affect, as does independent adjustment between the X-axis and Y-axis adjustments.

According to an aspect of the invention, the Y-axis and X-Y plane adjustments are independent of each other and a first intermediate component is provided that is adjustably secured to the mounting component and independently, adjustably secured to the clamp support to provide independent adjustment of the clamp support laterally in the Y-axis and angularly in the X-Y plane. Preferably, the mounting plate and the first intermediate component include a calibration scale and cooperating indicator for precise adjustment in the Y-axis. It is also preferable that the clamp support and the first intermediate component include a second calibration scale and cooperating indicator for precise adjustment in the X-Y plane.

According to an aspect of the invention, the lateral adjustment in the Y-axis is achieved by means of a threaded bolt that is threadably coupled at one end and rotatably mounted at its other end to achieve relative movement between components by rotation of the bolt. Preferably, angular adjustment in the X-Y plane is achieved by means of a similar threaded bolt arrangement.

According to another aspect of the invention, the Z-axis and X-Z plane adjustments are independent of each other and a second intermediate component is provided that is adjustably secured to the first intermediate component and independently, adjustably secured to one of the clamp support and mounting plate to provide independent adjustment of the clamp support laterally in the Z-axis and angularly in the X-Z plane. In this manner, intermediate components are provided so that separate and independent adjustments can be made between the components. Additional intermediate components can be provided and adjustably secured to the first and second intermediate components to allow for adjustment in the X-axis and the Y-Z plane. In this manner, the X-axis and Y-axis adjustments are independent of one another.

These and other features, objects, and advantages of the present invention will become apparent from the following description of the best mode for carrying out the invention, when read in conjunction with the accompanying drawings, and the claims, which are all incorporated herein as part of the disclosure of the invention.

BRIEF DESCRIPTION OF THE DRAWINGS

Throughout the several views, like reference numerals refer to like parts, wherein.

BEST MODE OF CARRYING OUT THE INVENTION

Reference will now be made in detail to the preferred embodiments of the invention, examples of which are illustrated in the accompanying drawings. While the invention will be described in conjunction with the preferred embodiments, it will be understood that the described embodiments are not intended to limit the invention specifically to those embodiments. On the contrary, the invention is intended to cover alternatives, modifications and equivalents, which may be included within the spirit and scope of the invention as defined by the appended claims.

Figure 1:
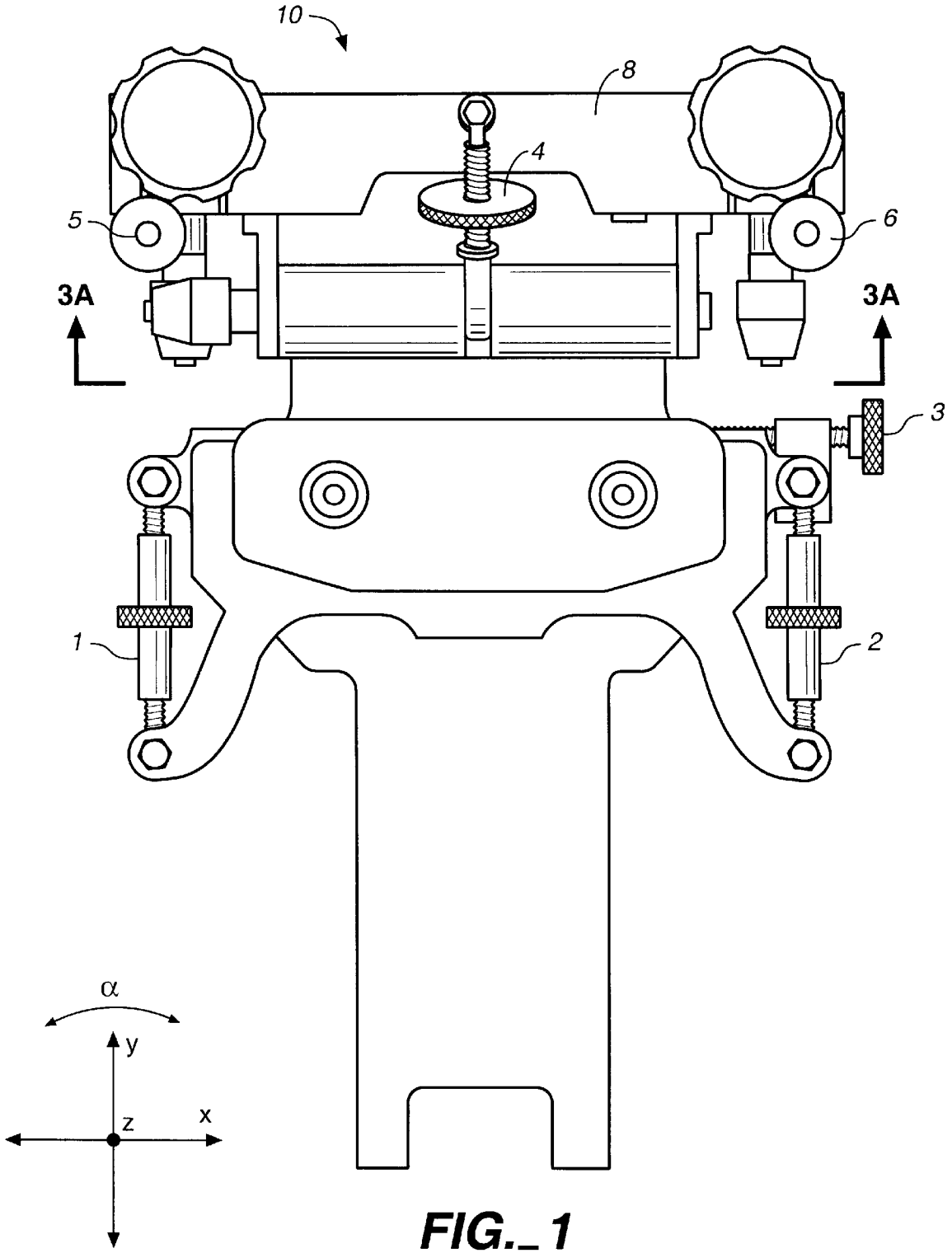
FIG. 1 (PRIOR ART)
FIG. 1 is a prior art Hopkins press arm.

FIG. 1 shows a Hopkins press arm 10 that provides 6-way adjustment of a printing screen. Provided are adjustments 1 and 2 for lateral movement in the Y-axis (in and out), adjustment 3 for lateral movement in the X-axis (sideways), and adjustments 5 and 6 for lateral adjustment in the Z-axis (up and down). Adjustments 1 and 2 also provide for angular movement in orthogonal plane X-Y plane (yaw), as indicated by reference letter $\alpha$, while adjustment 4 provides angular movement in the X-Z plane (tilt or roll), and adjustments 5 and 6 also provide angular movement in the Y-Z plane (pitch). For a skilled operator, the Hopkins press arm works well to accurately position a printing screen held by clamp mechanism 8, but as discussed herein, requires a certain skill and experience level in order to quickly and accurately make certain adjustments.

Figure 2B:
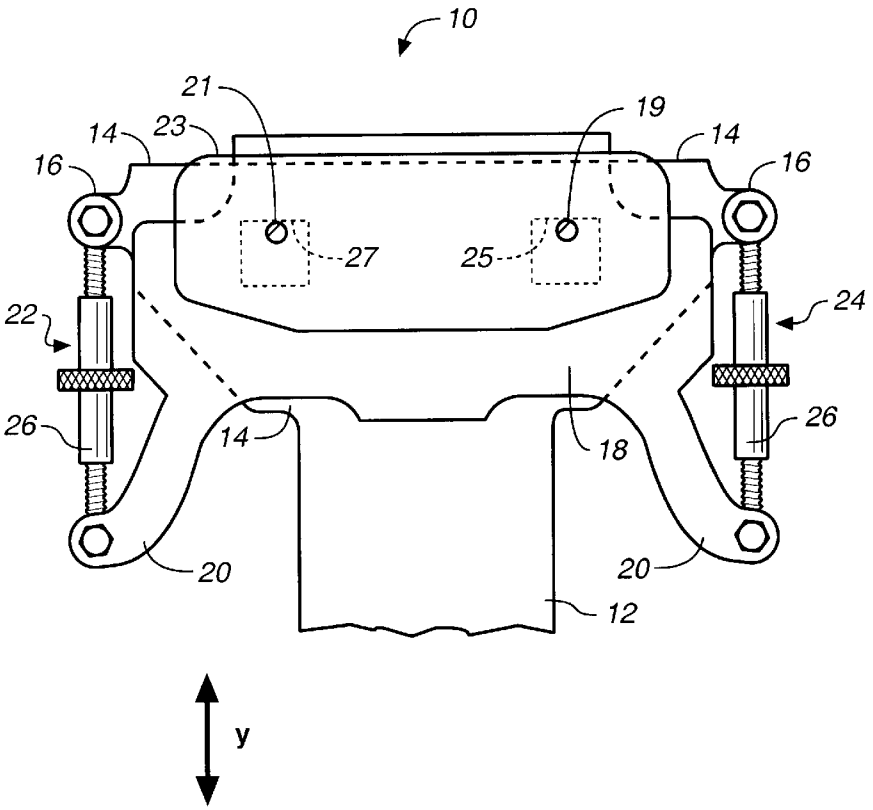
FIG. 2B (PRIOR ART)
FIGS. 2A and 2B are top plan views of components of the Hopkins press arm of FIG. 1 shown adjusted in and out in the Y-axis.
Figure 2A:
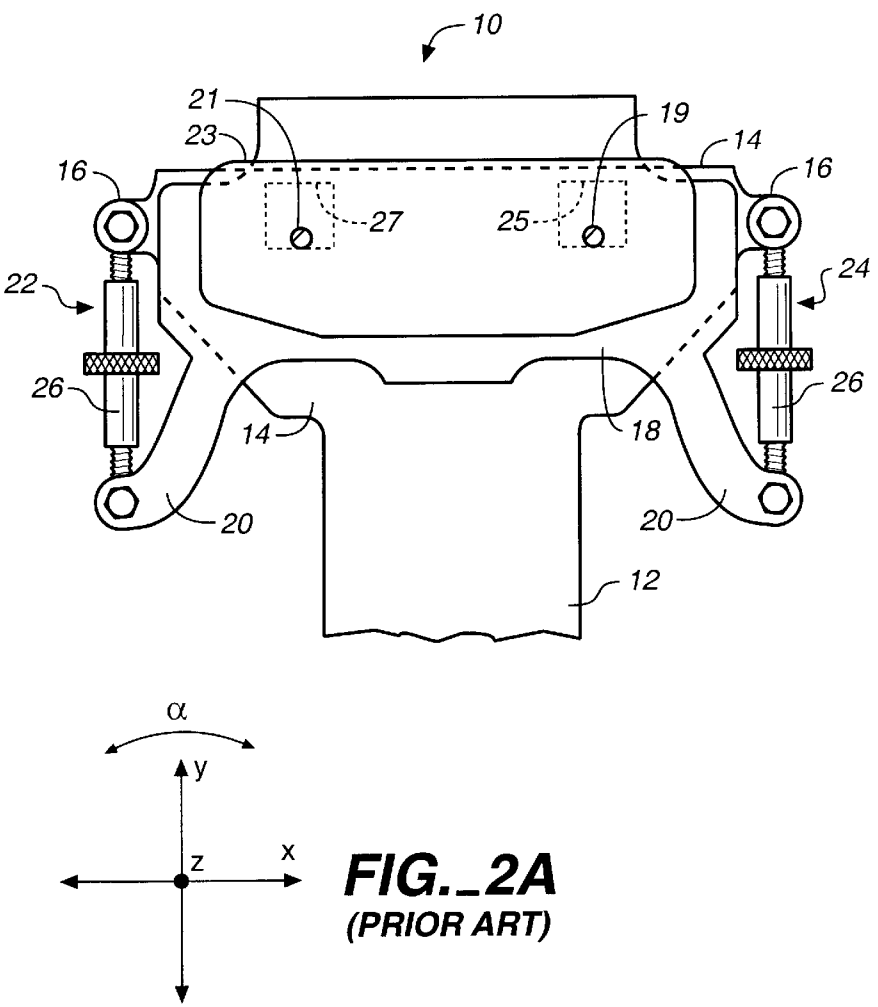
FIG. 2A (PRIOR ART)

Referring to FIGS. 2A and 2B, Hopkins press arm 10 is shown in top plan view with some of the components not shown in order to better illustrate the press arm's Y-axis and yaw (X-Y plane) adjustments. Press arm 10 includes a mounting plate 12 that pivotally attaches to a base structure of screen printing equipment. Mounting plate 12 has a wide forward end 14 with a pair of lobe-like projections 16 extending laterally outward from forward end 14. An intermediate adjustment plate 18 is carried on forward end 14 and includes a pair of rearwardly and outwardly angled legs 20. Intermediate adjustment plate 18 is secured to mounting plate 12 by a pair of clamp mechanisms that include a pair of pins 19, 21 to which the clamp components are attached. A clamp plate 23 is also provided that functions to clamp down on intermediate adjustment plate 18 to securely clamp it to mounting plate 12. Intermediate plate 18 includes a pair of rectangular openings 25, 27 through which pins 19, 21 extend. Between legs 20 and lobe projections 16, a pair of threaded adjustment mechanisms 22, 24 are mounted.

Adjustment mechanisms 22, 24 are independently adjustable and, if adjusted (by rotating collars 26) together in the same direction, cause adjustment plate 18 to move in and out in the direction of arrow Y, which moves in and out the clamp support holding the print screen. As can be seen, pins 19, 21 move within rectangular openings 25, 27 as plate 18 is adjusted relative to mounting plate 12. The clamp support is part of the forward press arm components that are not shown but which are attached to plate 18 and move therewith.

Figure 2D:
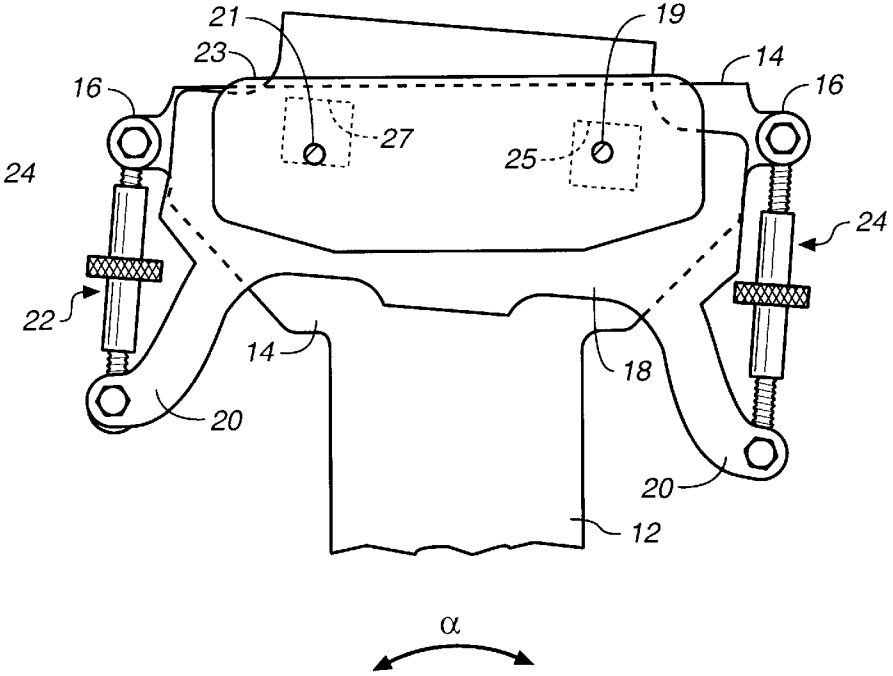
FIG. 2D (PRIOR ART)
FIGS. 2C and 2D are top plan views of the components of FIGS. 2A and 2B shown adjusted angularly in the X-Y plane.
Figure 2C:
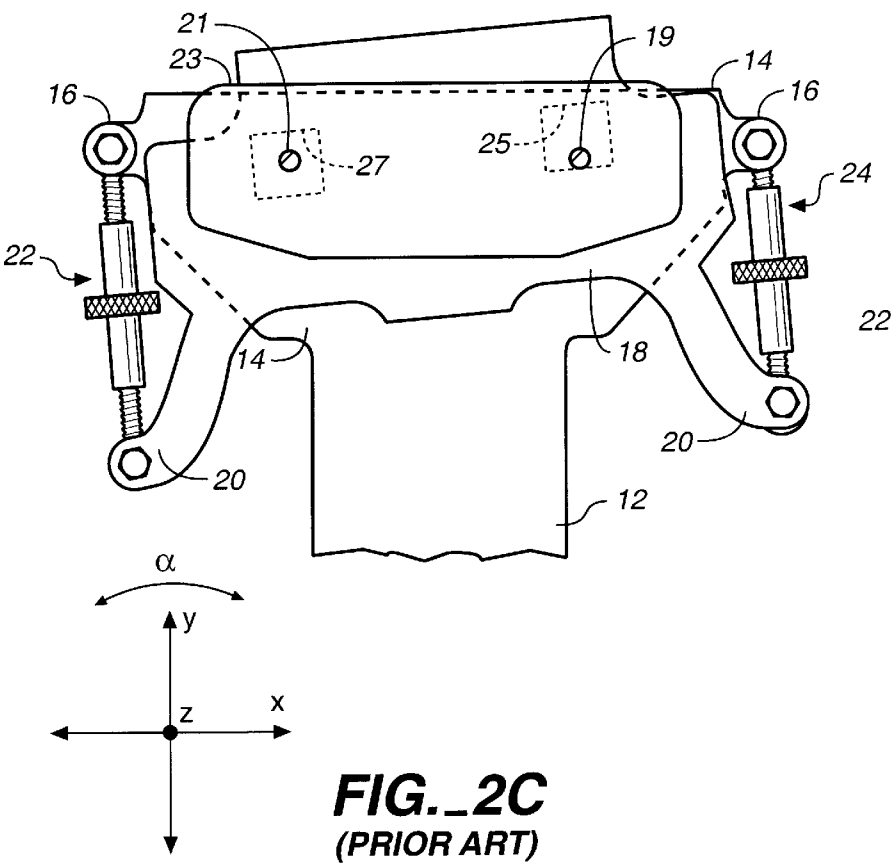
FIG. 2C (PRIOR ART)

Referring to FIGS. 2C and 2D, adjustment of mechanisms 22, 24 in opposite directions causes an angular adjustment $\alpha$ in the X-Y plane, which affects the yaw of the clamp support. In FIG. 2C, plate 18 is angularly rotated to the left and in FIG. 2D, plate 18 is angularly rotated to the right. It can also be seen how the relative positions of pins 19, 21 and rectangular openings 25, 27 change when the yaw adjustment is made. Because it is difficult to adjust both mechanisms 22, 24 uniformly, attempted adjustment in or out typically results in at least a slight angular adjustment in the X-Y plane. Hence, adjustment in and out in the Y-axis is not independent of angular adjustment in the X-Y plane and as a result, proper adjustment of either requires a certain skill and experience level that comes from working with the press arm over time.

Figure 2F:
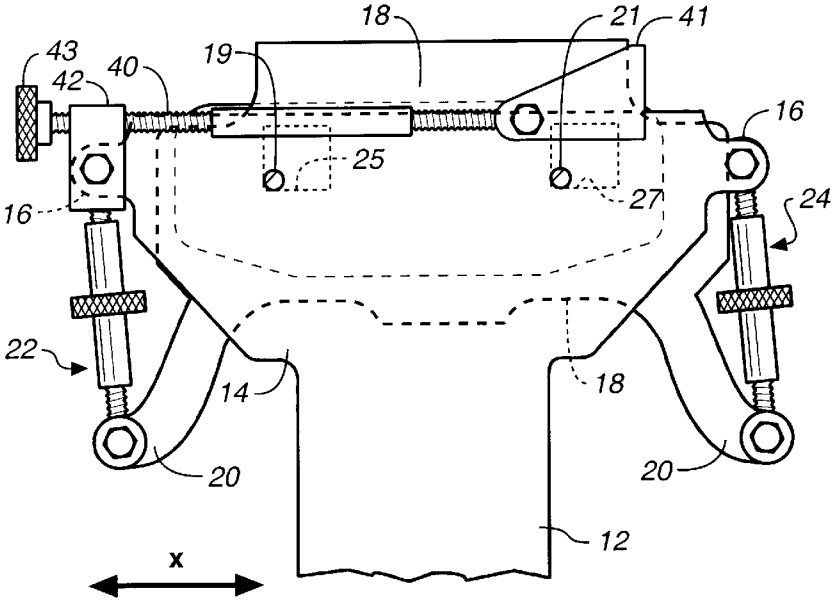
FIG. 2F (PRIOR ART)
FIGS. 2E and 2F are top plan views of the components of FIG. 2A and 2B shown adjusted laterally in the X-axis.
Figure 2E:
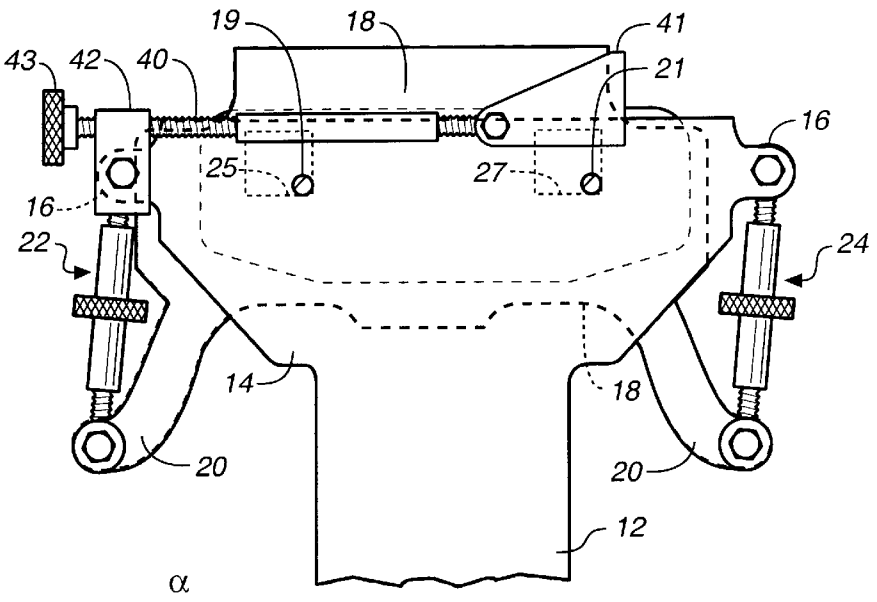
FIG. 2E (PRIOR ART)

Referring to FIGS. 2E and 2F, movement of the clamp support in the X-axis is achieved by means of a transverse threaded bolt 40, connected at one end to the underside of adjustment plate 18 by an L-shaped bracket 41 and rotatably secured at its other end to mounting plate 12 at lug 42. Rotation of knob 43 causes lug 42 and bracket 41 to move laterally toward or away from each other, which causes relative lateral movement between mounting plate 12 and adjustment plate 18. FIG. 2E shows plate 18 laterally shifted to the left while FIG. 2F shows plate 18 laterally shifted to the right.

Figure 2G:
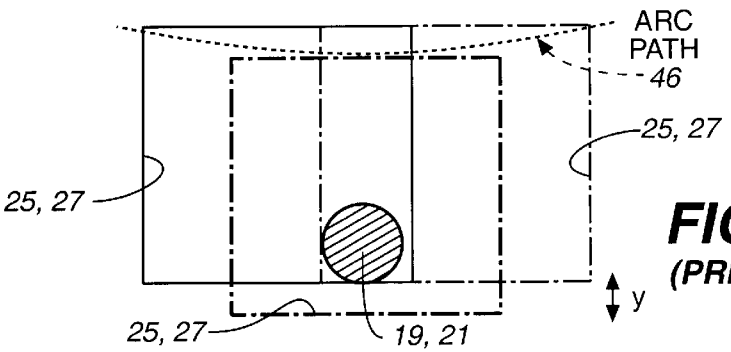
FIG. 2G (PRIOR ART)
FIG. 2G is a schematic view illustrating the Y-axis adjustment that results from making a lateral X-axis adjustment.

Because the relative positions of mounting plate 12 and adjustment plate 18 are affected by both adjustment mechanisms 22, 24 and threaded bolt 40, lateral adjustment of plate 18 by means of threaded bolt 40 affects the in and out position of plate 18. Specifically, adjustment mechanisms 22, 24 set the distance between projections 16 and legs 20. As a result, relative lateral movement of adjustment plate 18 relative to mounting plate 12 is actually along a slightly arcuate path, as depicted by phantom line 46 in FIG. 2G. Movement through arcuate path 46, as depicted by movement of rectangular openings 25, 27 in plate 18, causes a small in and out movement, depicted by arrow Y. Consequently, adjustments in the X-axis and Y-axis are not independent of one another, and a person making a lateral adjustment of plate 18 must be aware of the corresponding movement in the Y-axis.

Figure 3A:
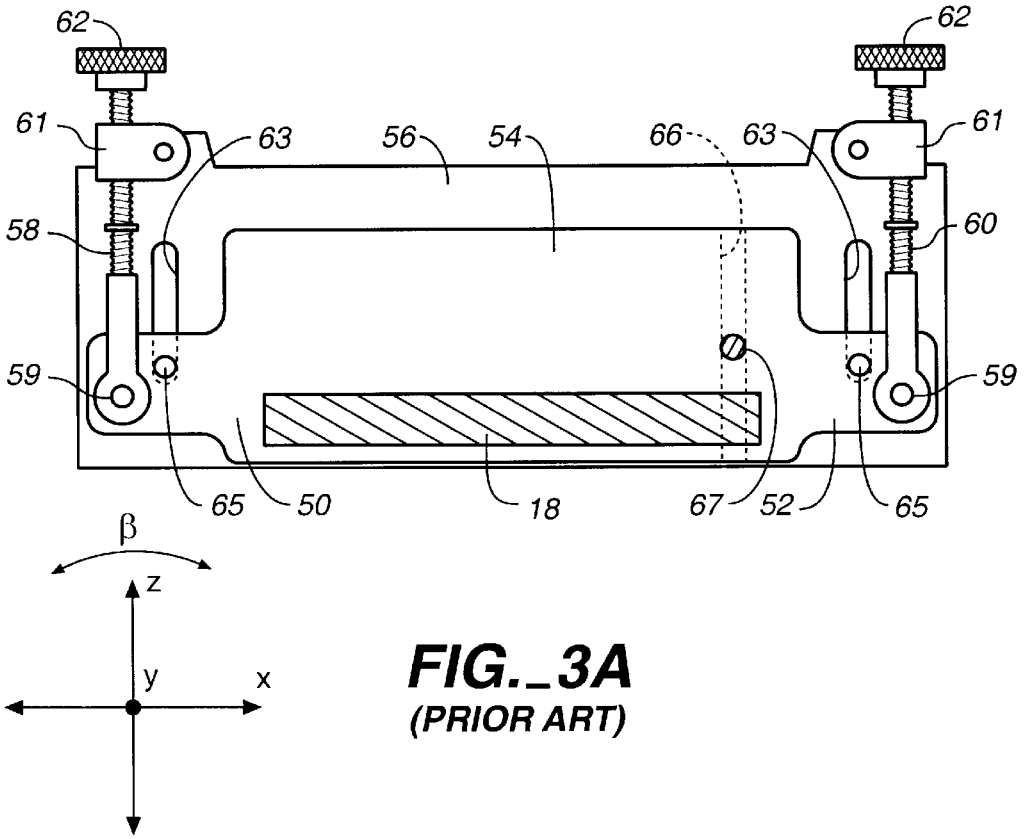
FIG. 3A (PRIOR ART)
FIGS. 3A and 3B are elevation views of components of the Hopkins press arm of FIG. 1 shown adjusted up and down in the Z-axis.
Figure 3B:
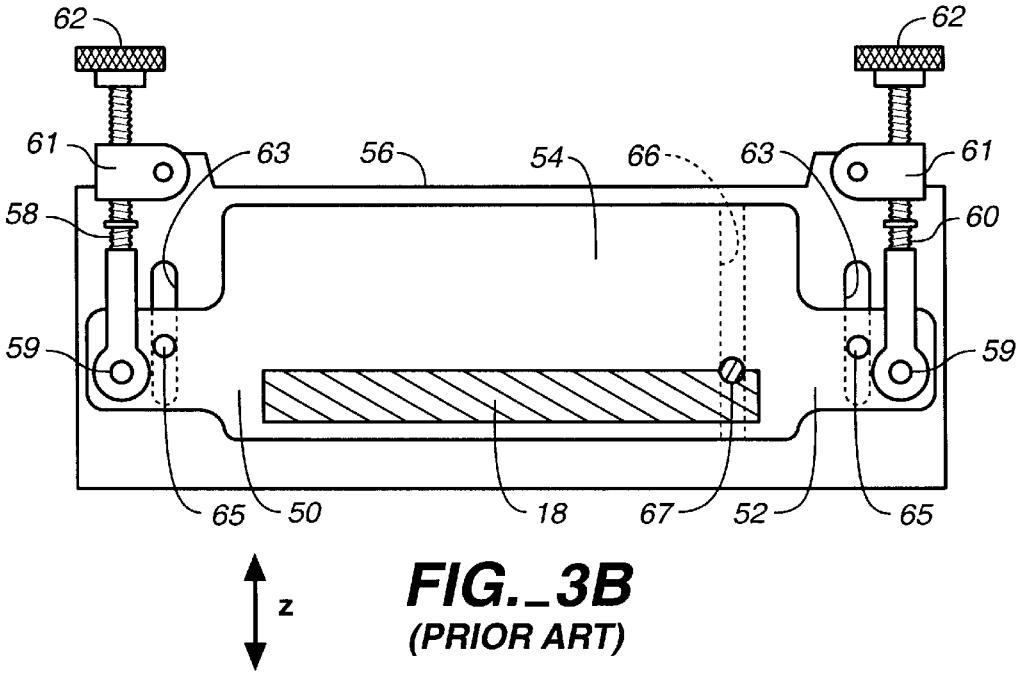
FIG. 3B (PRIOR ART)

Referring to FIGS. 3A and 3B, Hopkins press arm 10 further includes a pair of L-shaped bracket mounts 50, 52, which are mounted to the upright forward end 54 of adjustment plate 18. Bracket mounts 50, 52 move as a unit with adjustment plate 18. A clamp support 56 for holding a print screen is movably mounted at the front sides of bracket mounts 50, 52 by a pair of vertical threaded adjustment mechanisms 58, 60, which provide for relative vertical movement between clamp support 56 and bracket mounts 50, 52. Each threaded adjustment mechanism 58, 60 is secured at its lower end by a universal pivot 59 to a one of bracket mounts 50, 52 and at its upper end by a second universal pivot 61 to the back side of clamp support 56. Rotational adjustment of knobs 62 together in the same direction causes either up or down movement of the clamp support, depending on the direction of rotation. FIG. 3A shows clamp support 56 in an up position and FIG. 3B shows clamp support 56 in a down position.

Figure 3C:
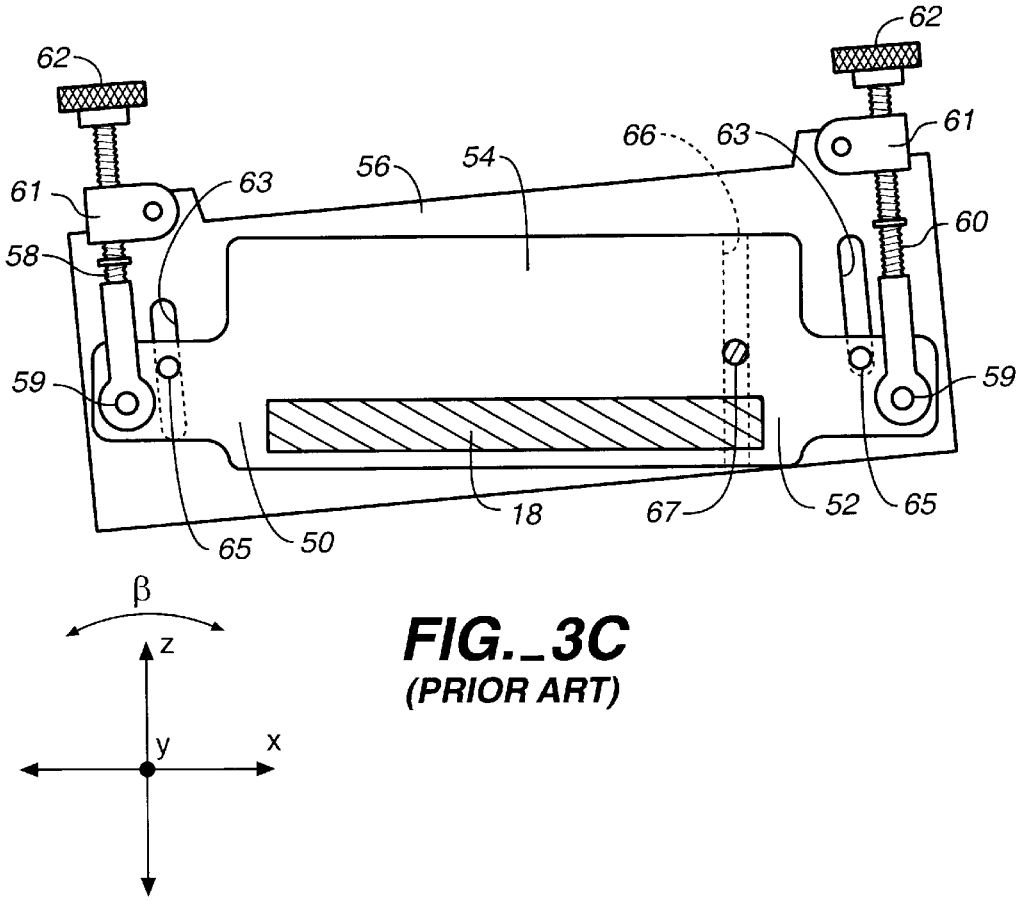
FIG. 3C (PRIOR ART)
FIGS. 3C and 3D are elevation views of the components of FIGS. 3A and 3B shown tilted in the X-Z plane.
Figure 3D:
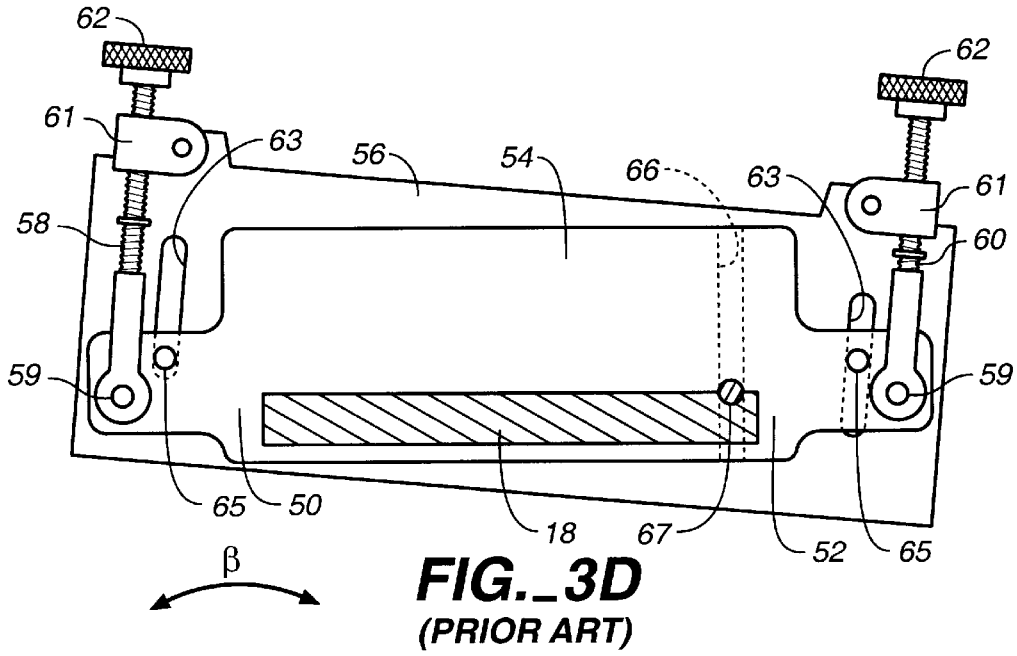
FIG. 3D (PRIOR ART)

Rotational adjustment of knobs 62 in opposite directions causes angular adjustment in the X-Z plane, which adjustment is sometimes referred to as tilt or roll. FIG. 3C shows clamp support rotated to the left and FIG. 3D shows clamp support rotated to the right. Slots 63 are provided in clamp support 56 for clamp mechanisms (not shown) but which include pins 65 for securing clamp support 56 to brackets 50, 52. A vertical channel 66 is provided in L-shaped bracket 52 for receiving a guide pin 67 that is secured to the back side of clamp support 56. As clamp support 56 moves up and down relative to brackets 50, 52, guide pin 67 slides within channel 66. Also, when clamp support 56 rotates relative to brackets 50, 52, guide pin 67 slides in channel 66 and thereby acts as the pivot point for angular rotation of the clamp support.

However, uniform rotation of knobs 62, to achieve a vertical adjustment, is difficult and often not entirely precise, resulting in a partial angular adjustment in the X-Z plane. In addition, angular adjustment in the X-Z plane produces a slight lateral adjustment in the X-axis, due to the position of pivot point 67.

The combined, non-independent adjustment design of the Z-axis and X-Z plane adjustments, like the combined adjustment of the Y-axis and the X-Y plane adjustments, requires a certain skill and experience level to accurately position the clamp support. For less experienced and novice operators, such an adjustment can be complicated and require repeated adjustments, which results in a more time consuming operation.

Figure 4A:
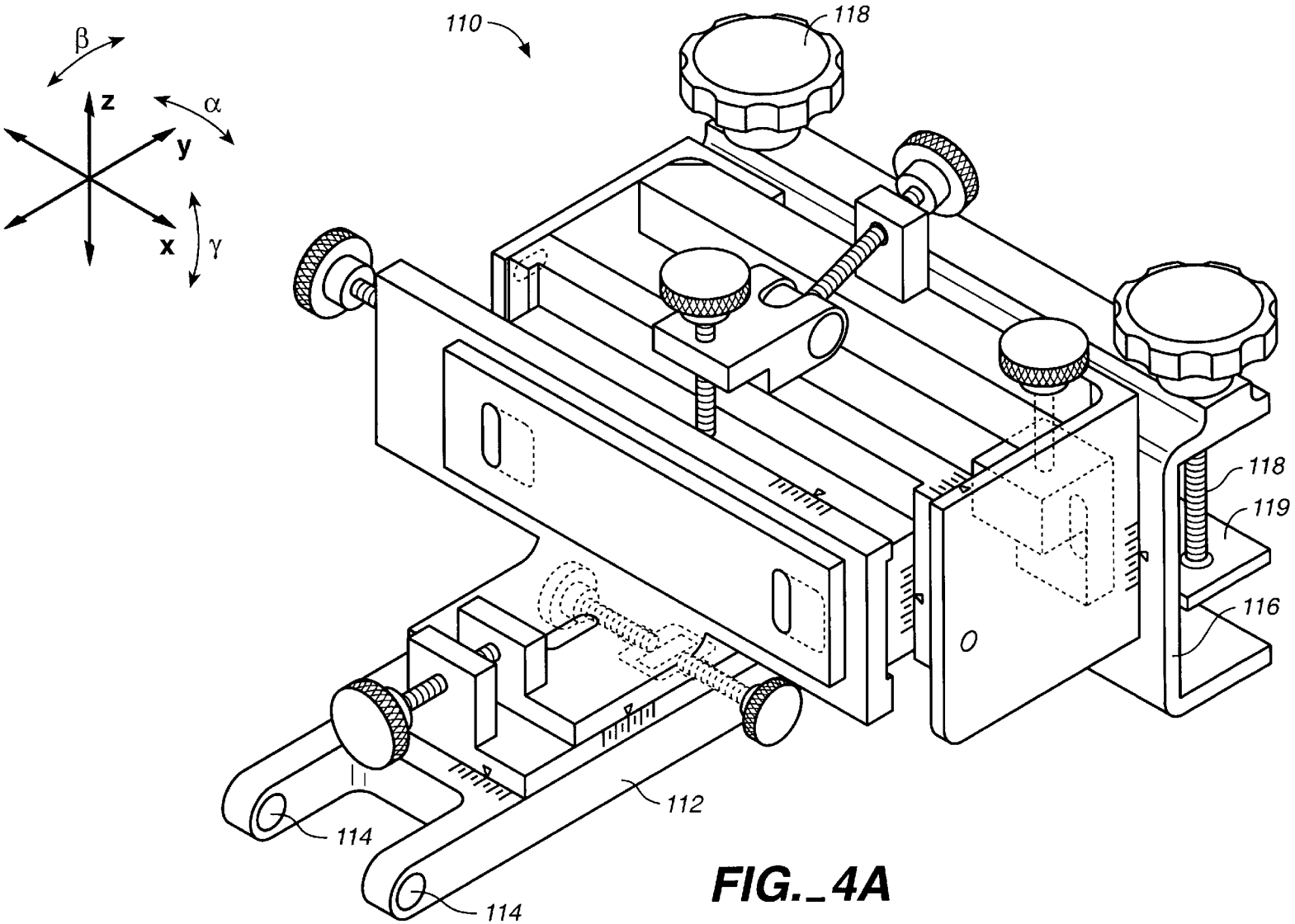
FIG. 4A is a pictorial view of the press arm of the present invention shown with the clamp mechanisms removed to illustrate various hidden features.

In FIG. 4A, the improved press arm 110 of the present invention is shown to include an elongated mounting plate 112 with bores 114 for pivotally mounting of press arm 110 to a base structure. The assignee of the present invention, BWM, Inc. of Modesto, Calif., USA, sells screen printing equipment, such as its 1900 and 4400 series, that include base structures with which press arm 110 is compatible.

Figure 4B:
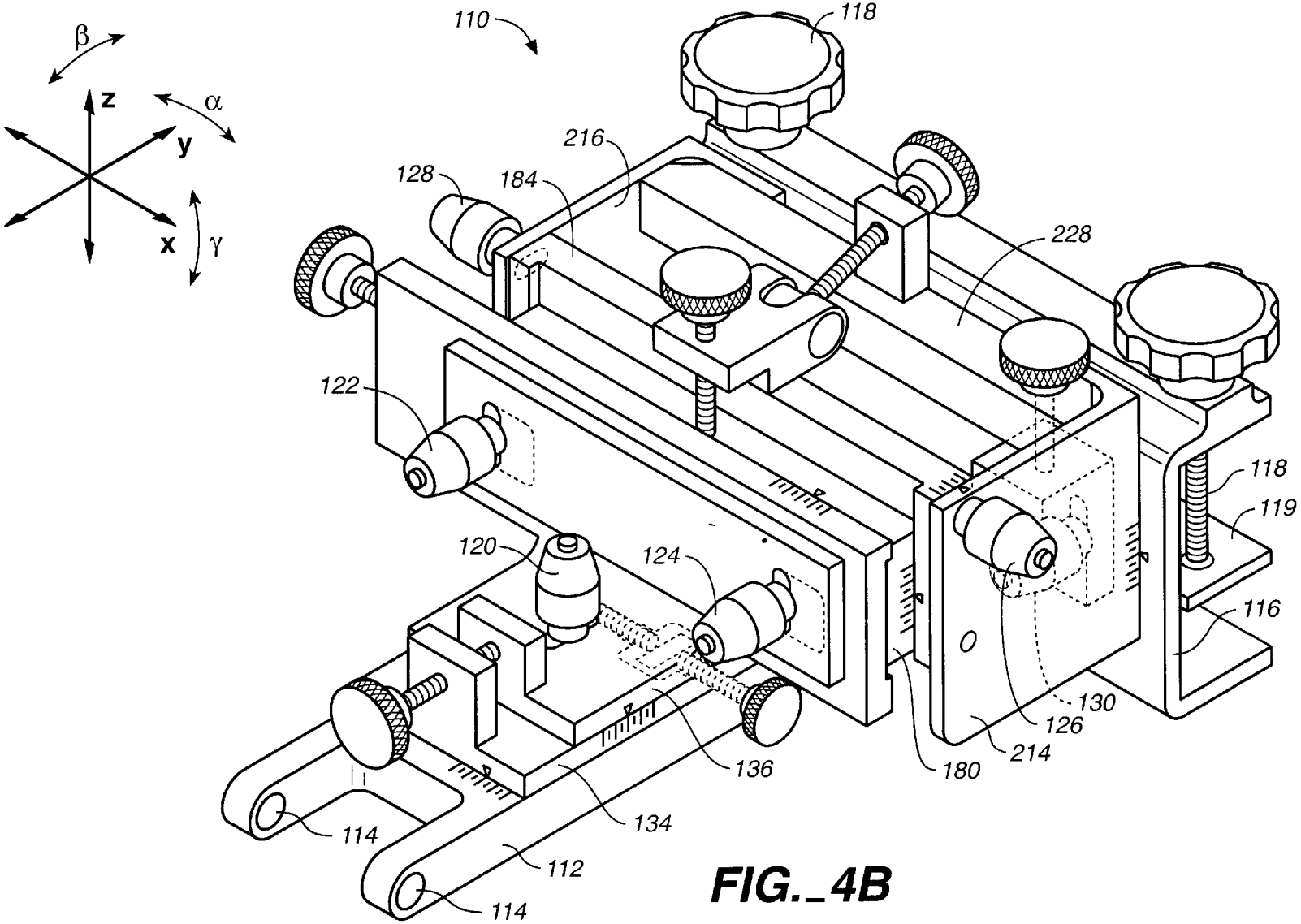
FIG. 4B is a pictorial view of the press arm of FIG. 4A shown with the clamp mechanisms.

At the front end of press arm 110 is mounted a C-shaped clamp support 116 that carries a pair of vertically oriented clamp bolts 118, which pivotally carry a clamp plate 119 for clamping against the frame of a print screen for positioning of the screen above an article to be printed. In between mounting plate 112 and clamp support 116 are a series of intermediate components that are movable relative to each other and are discussed in more detail in FIGS. 5A–10B. In FIG. 4A, the clamp mechanisms for securing the various intermediate components together after adjustment are not shown in order to illustrate certain features of the invention. In FIG. 4B, clamp mechanisms 120, 122, 124, 126, 128 and 130 are illustrated, but are discussed in more detail later. Each clamp mechanism preferably includes a handle (not shown) for leveraging the mechanism in order to overcome the frictional clamping resistance.

In the figures herein, the X-, Y-, and Z-axis are labeled and shown in the upper right corner of each figure. Additionally, angular rotation in the X-Y plane, which is referred to herein as "yaw", is indicated by reference letter $\alpha$, and angular rotation in the Y-Z plane, which is referred to herein as "pitch", is indicated by reference letter $\beta$, and angular rotation in the X-Z plane, which is referred to herein as "roll" or "tilt", is indicated by reference letter $\gamma$.

Figure 5A:
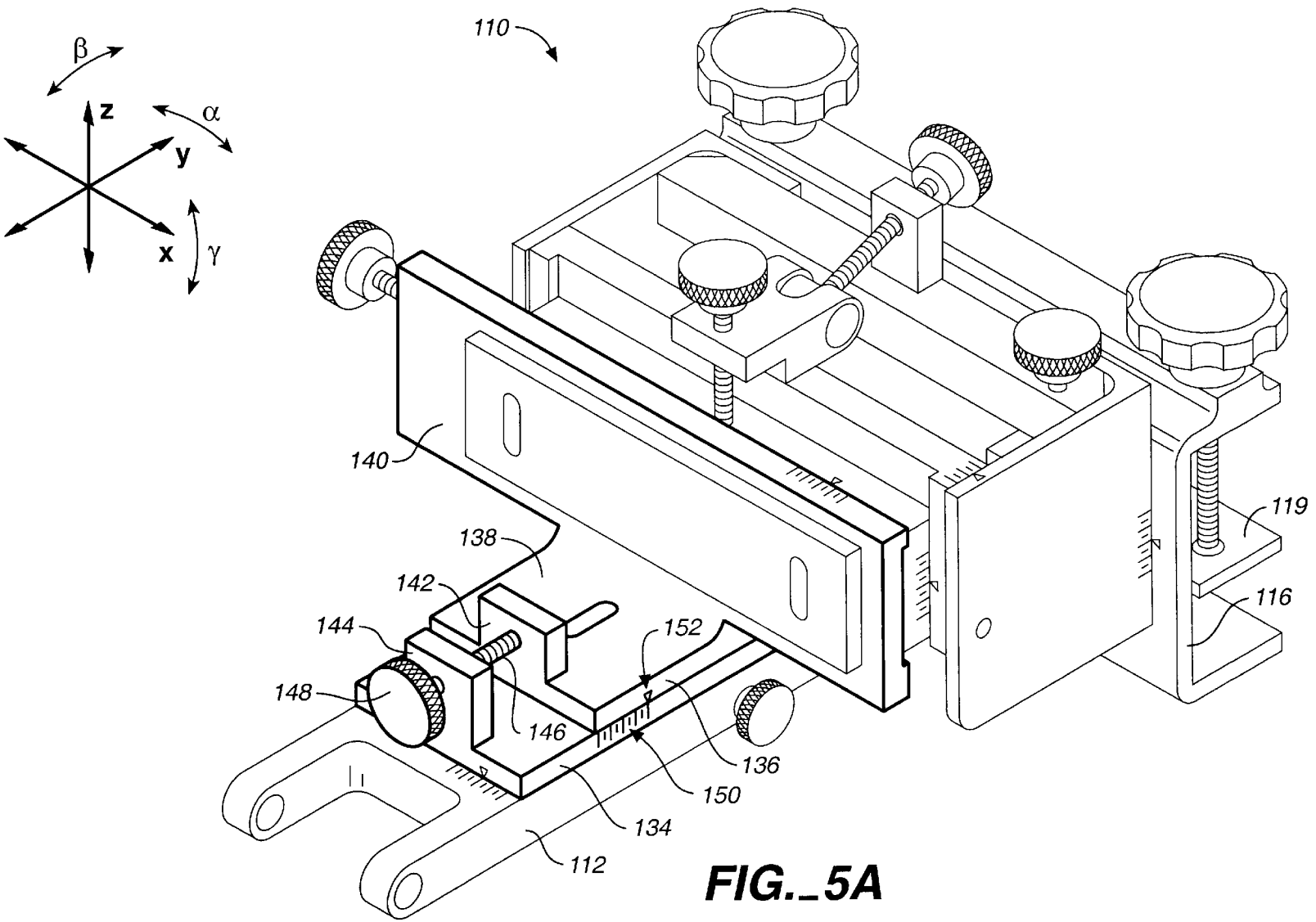
FIGS. 5A and 5B are pictorial views of the components for making an in-and-out, Y-axis adjustment.
Figure 5B:
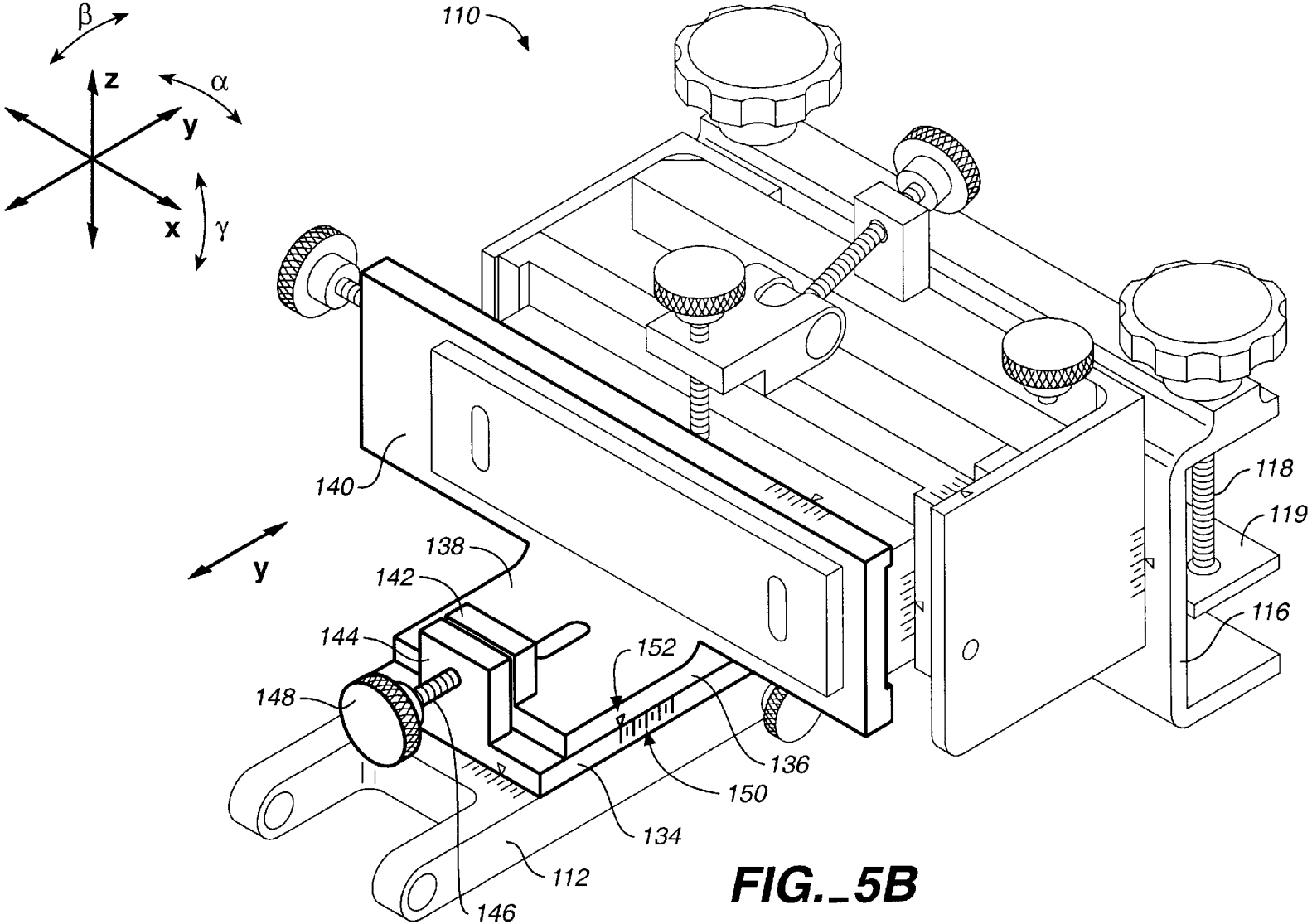

Referring to FIGS. 5A and 5B, press arm 110 further includes an angularly adjustable intermediate plate 134, which is pivotally secured to mounting plate 112 by means of clamp mechanism 120 (FIG. 4B). Above intermediate plate 134 is slidably mounted a second L-shaped intermediate plate 136 that has a flat, rearwardly extending plate 138 and an upright laterally elongated plate 140. Upstanding brackets 142, 144 cooperatively provide mounts for a threaded bolt 146 and knob 148 and form an adjustment mechanism for moving plate 136 relative to plate 134 in and out along the Y-axis.

Bolt 146 is rotatably secured within bracket 142 and threadably coupled within bracket 144. Plate 134 further includes a scale 150 and plate 136 includes an indicator mark 152. In FIG. 5A, second intermediate plate 136 is moved to its farthest forward position, at which point indicator mark 152 is at the forward end of scale 150. In FIG. 5B, second intermediate plate 136 is moved to its most rearward position, at which point indicator mark 152 is at the rear end of scale 150. As will become apparent from the following discussion, adjustment of plates 134 and 136 relative to one another does not affect the adjustments of any other components or the position of clamp support 116 except along the Y-axis.

Figure 6A:
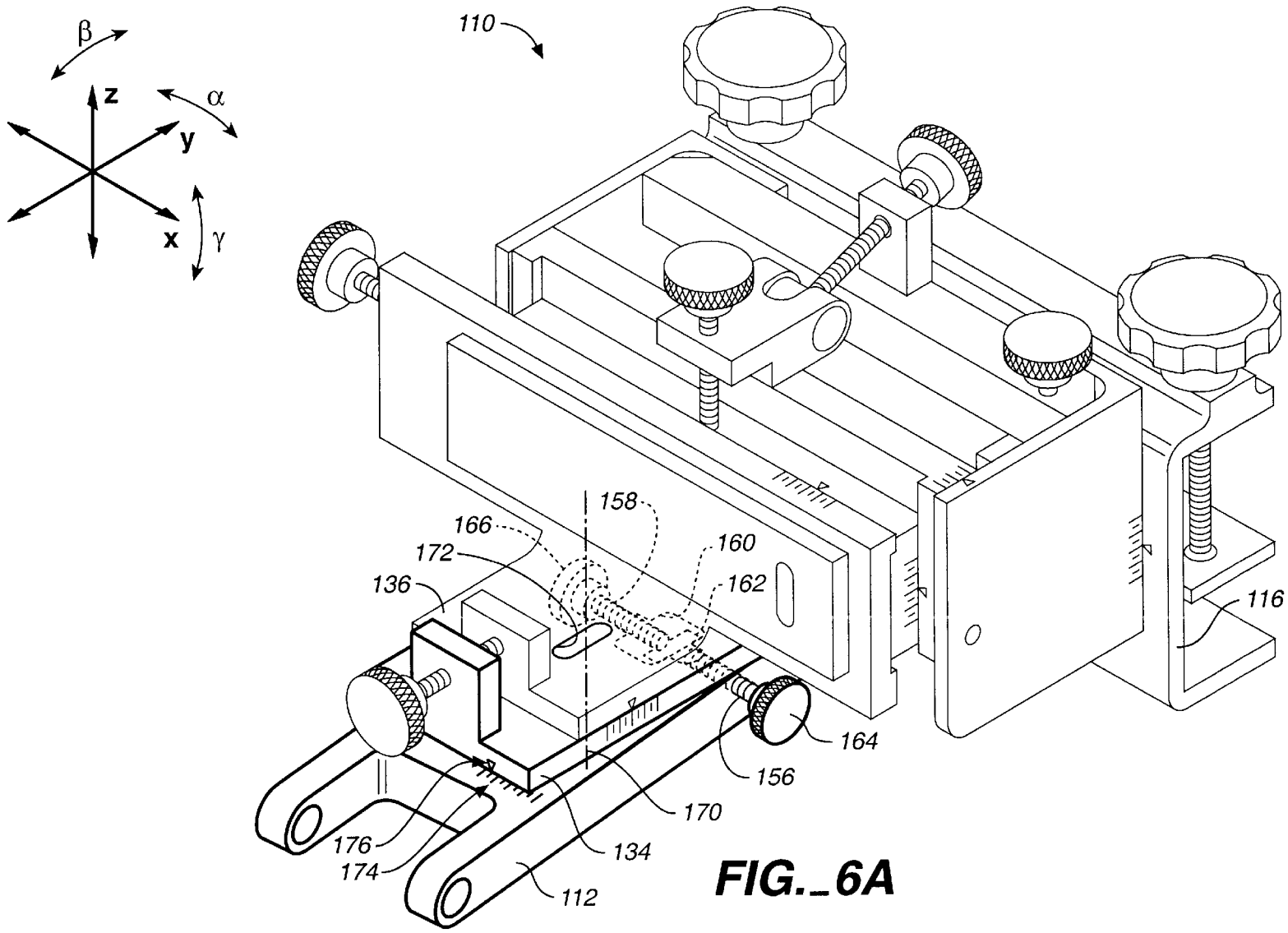
FIGS. 6A and 6B are pictorial views.
Figure 6B:
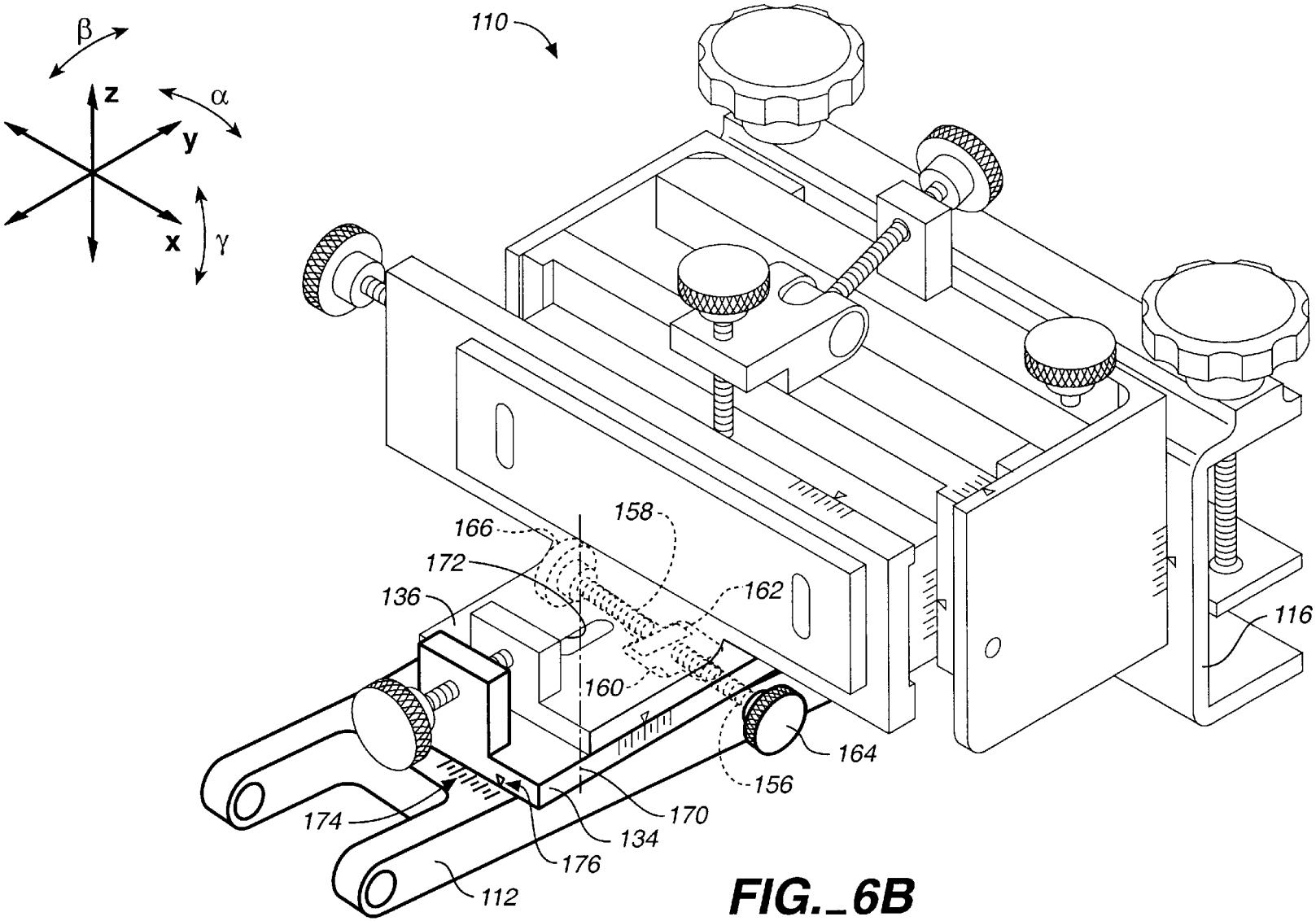
Figure 6C:
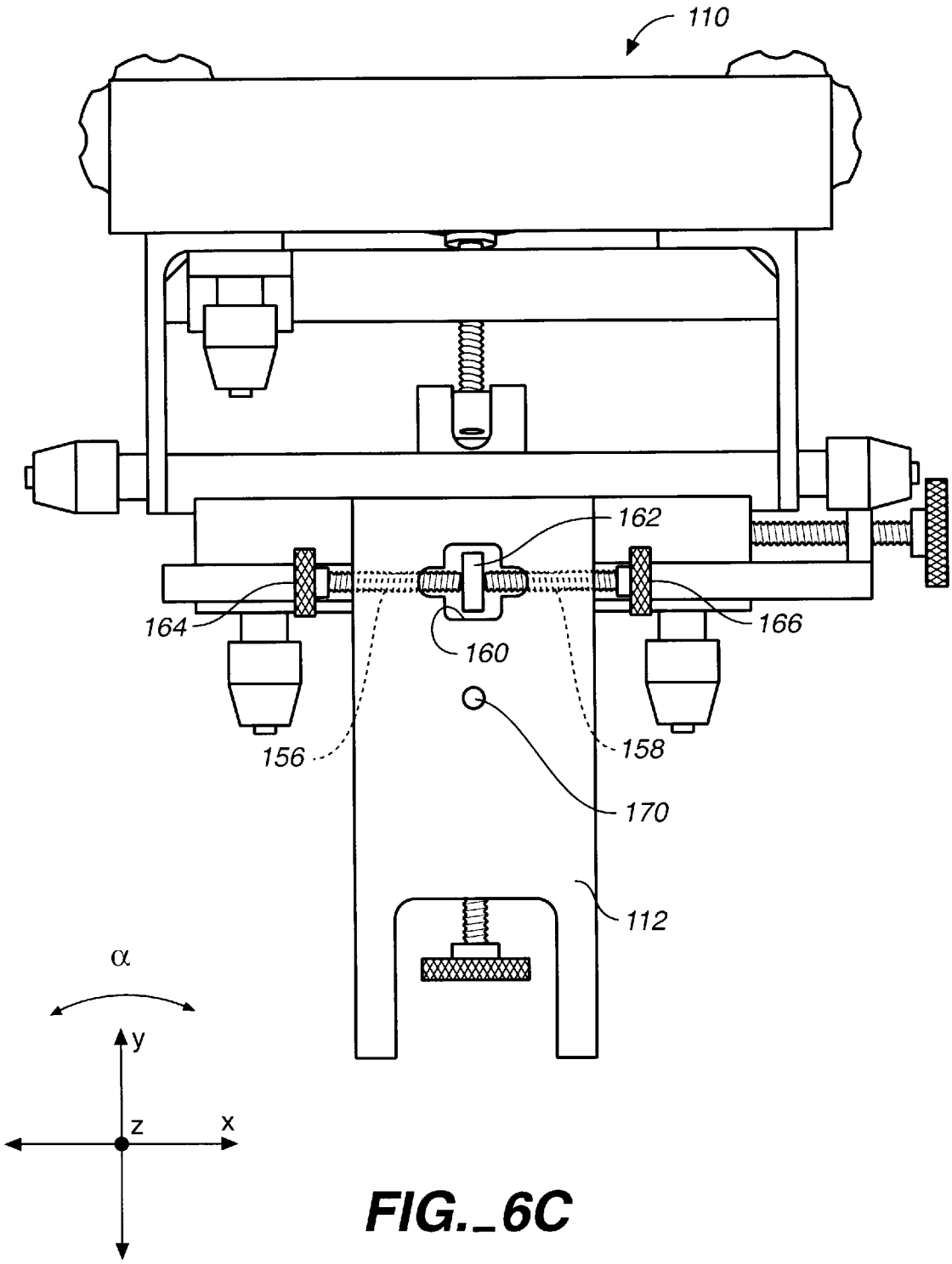
FIG. 6C is a bottom view of the components for making a yaw adjustment.

Referring to FIGS. 6A, 6B and 6C, the yaw adjustment of press arm 110 is illustrated. A pair of transverse adjustment bolts 156, 158 are threadably mounted within sidewalls of mounting plate 112 and extend into an interior cavity 160 of mounting plate 112 in which is positioned a stop block 162. Stop block 162 is rigidly secured to the underside of intermediate plate 134 and projects down into the cavity 160. Knobs 164, 166 can be rotated to move bolts 156, 158 laterally in and out along the X-axis to push stop block 162 laterally and thereby pivot intermediate plate 134 about the vertical axis 170, where a releasable clamp mechanism (not shown) is provided. As discussed later, the clamp mechanism extends up through a slot 172 in plate 136 and up through an aligned, but transversely oriented slot (not shown) in plate 134. Slot 172 allows for relative in and out movement along the Y-axis between plate 134 and plate 136.

Mounting plate 112 includes a scale 174 and intermediate plate 134 includes an indicator mark 176. FIG. 6A shows transverse adjustment bolt 156 fully retracted outwardly and transverse adjustment bolt 158 fully rotated inwardly, which pushes stop block 162 laterally to the right as shown and thereby angularly adjusts clamp support 116 to the right. This adjustment is indicated by scale 174 and indicator mark 176. FIG. 6B shows transverse adjustment bolt 156 fully threaded inwardly and transverse adjustment bolt 158 fully threaded outwardly, which pushes stop block 162 to the left. This causes plate 134 to pivot about axis 170, resulting in angular adjustment of clamp support 116 to the left.

Figure 7A:
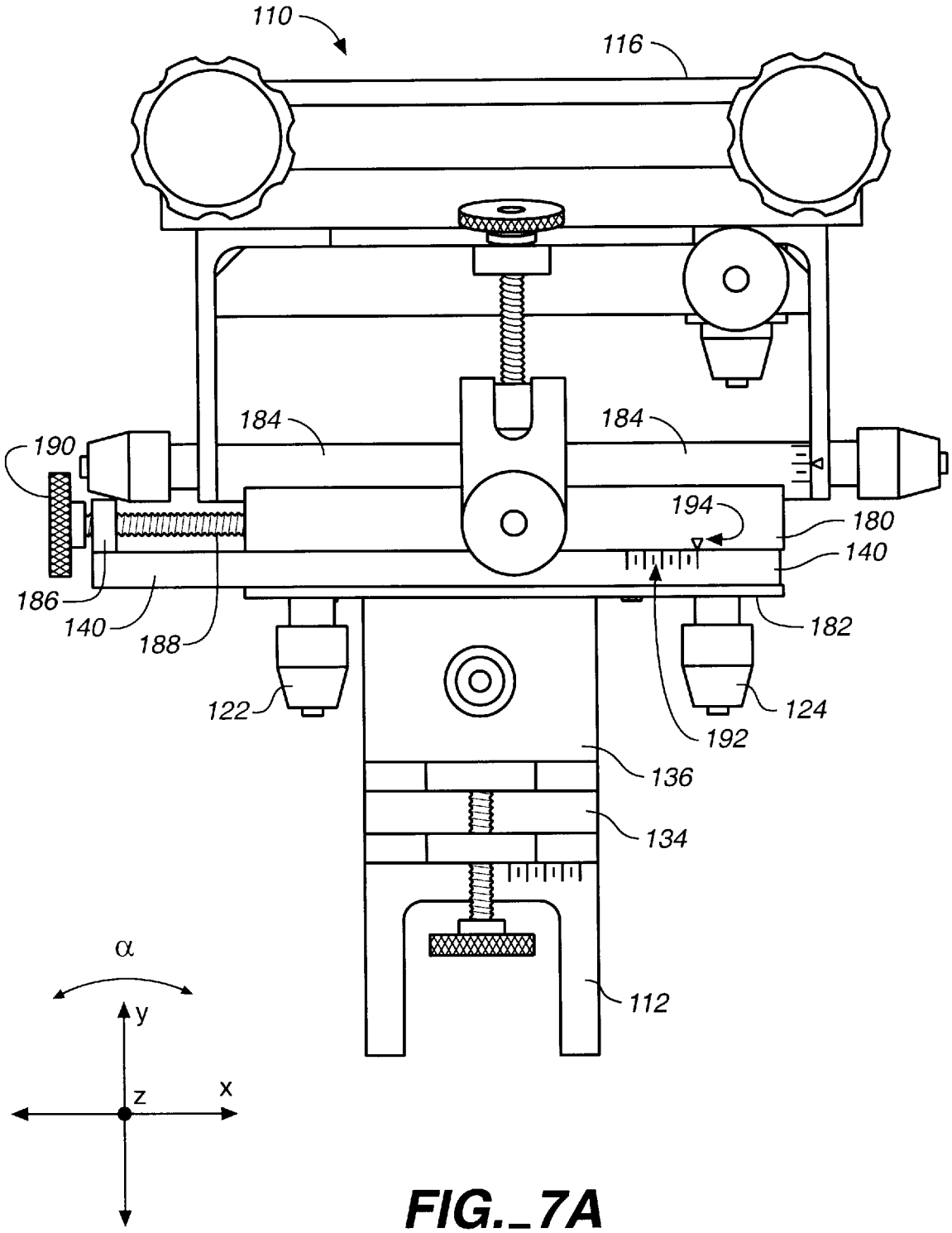
FIGS. 7A and 7B are plan views of the components for making a sideways or lateral X-axis adjustment.
Figure 7B:
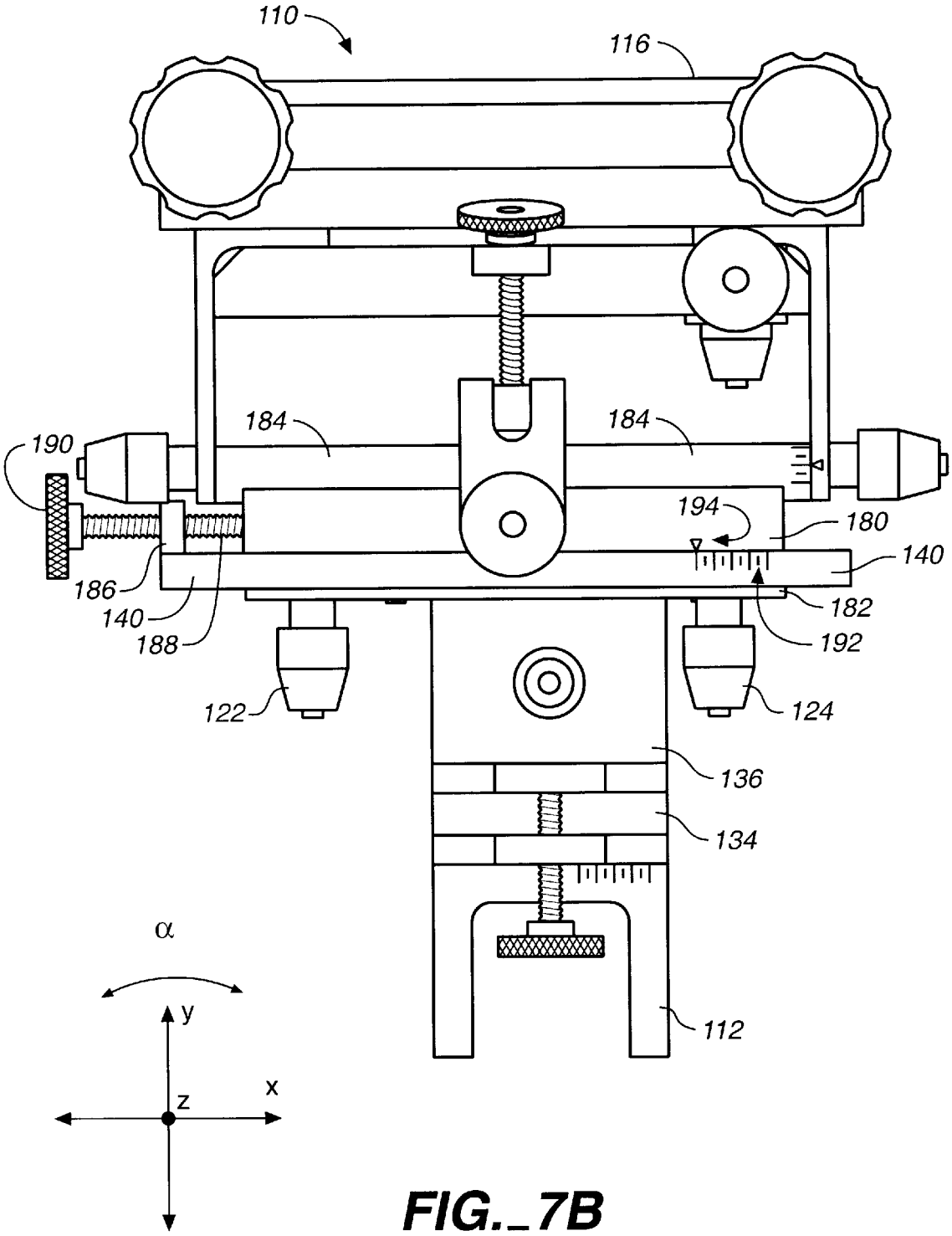

Referring to FIGS. 7A and 7B, press arm 110 further includes a third intermediate block 180 and clamp plate 182, which are clamped to upright plate 140 and are movably mounted to a fourth intermediate backing plate 184. A pair of releasable clamp mechanisms 122, 124 secure components 180, 182, 184 together, yet allow for their relative movement as discussed herein by backing off or releasing the clamp mechanisms.

A forwardly extending mounting bracket 186 is rigidly secured at one end of plate 140. A transverse, threaded adjustment bolt 188 threadably couples to bracket 186 and is rotatably secured within one end of third intermediate block 180. Rotation of knob 190 causes relative lateral movement along the X-axis between component 140 and 180. Because clamp support 116 is indirectly secured to backing plate 184, adjustment of threaded bolt 188 causes adjustment of clamp support 116 laterally in the X-axis.

Plate 140 includes a scale 192 and block 180 includes an indicator mark 194. In FIG. 7A, threaded bolt 188 is shown completely retracted outwardly, resulting in adjustment of clamp support 116 to its farthest right position, as shown by the relative position of indicator mark 194 and scale 192. In FIG. 7B, threaded bolt 188 is fully rotated inwardly, which positions block 180, and therefor clamp support 116, to the left, as shown by the position of indicator mark 194 relative to scale 192. As can be seen, lateral adjustment of block 180 in the X-axis does not affect the Y-axis adjustment or the yaw (X-Y plane) adjustment because separate intermediate components are provided for each adjustment.

Figure 8A:
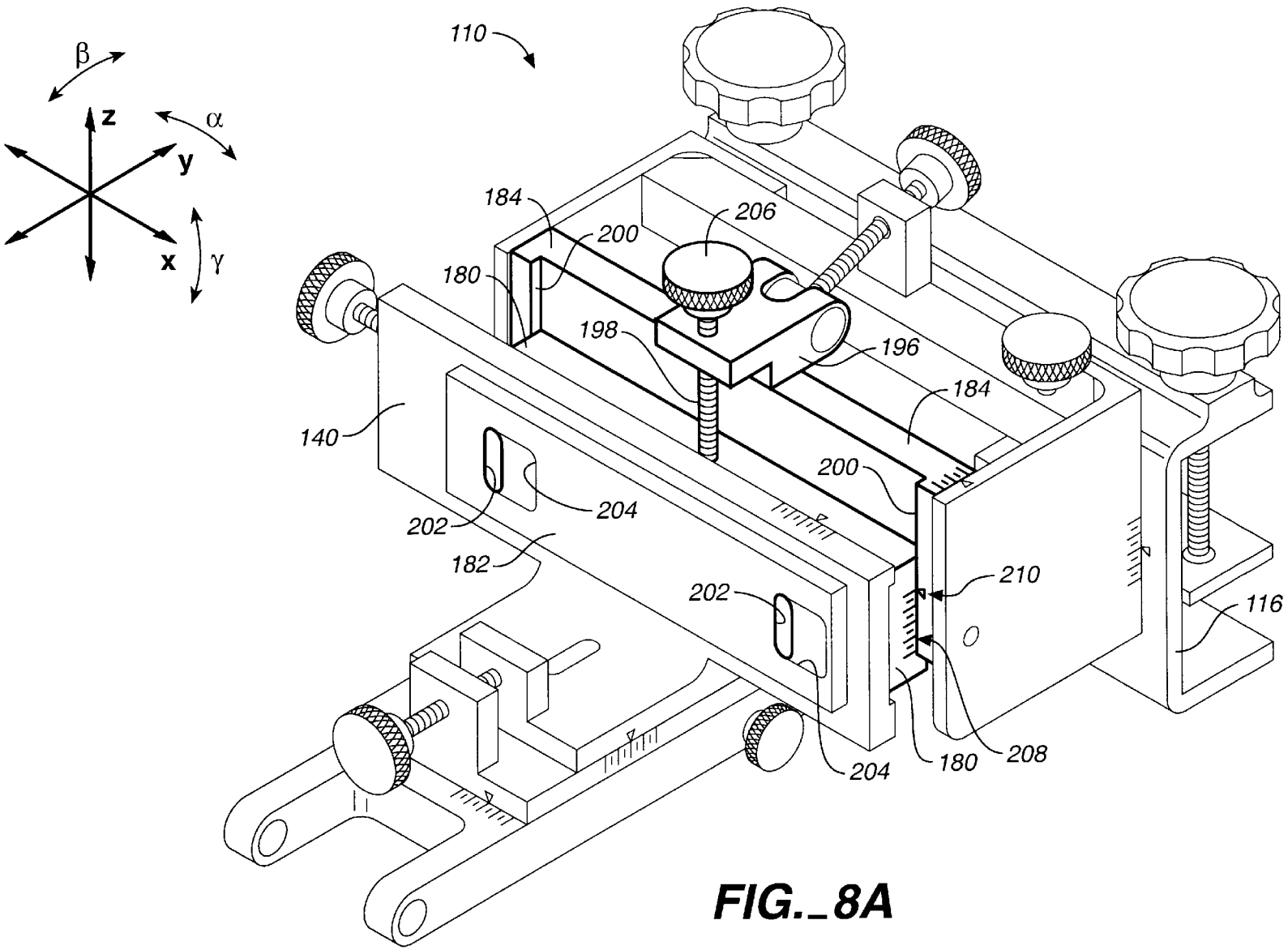
FIGS. 8A and 8B are pictorial views of the components for making an up-and-down, Z-axis adjustment.
Figure 8B:
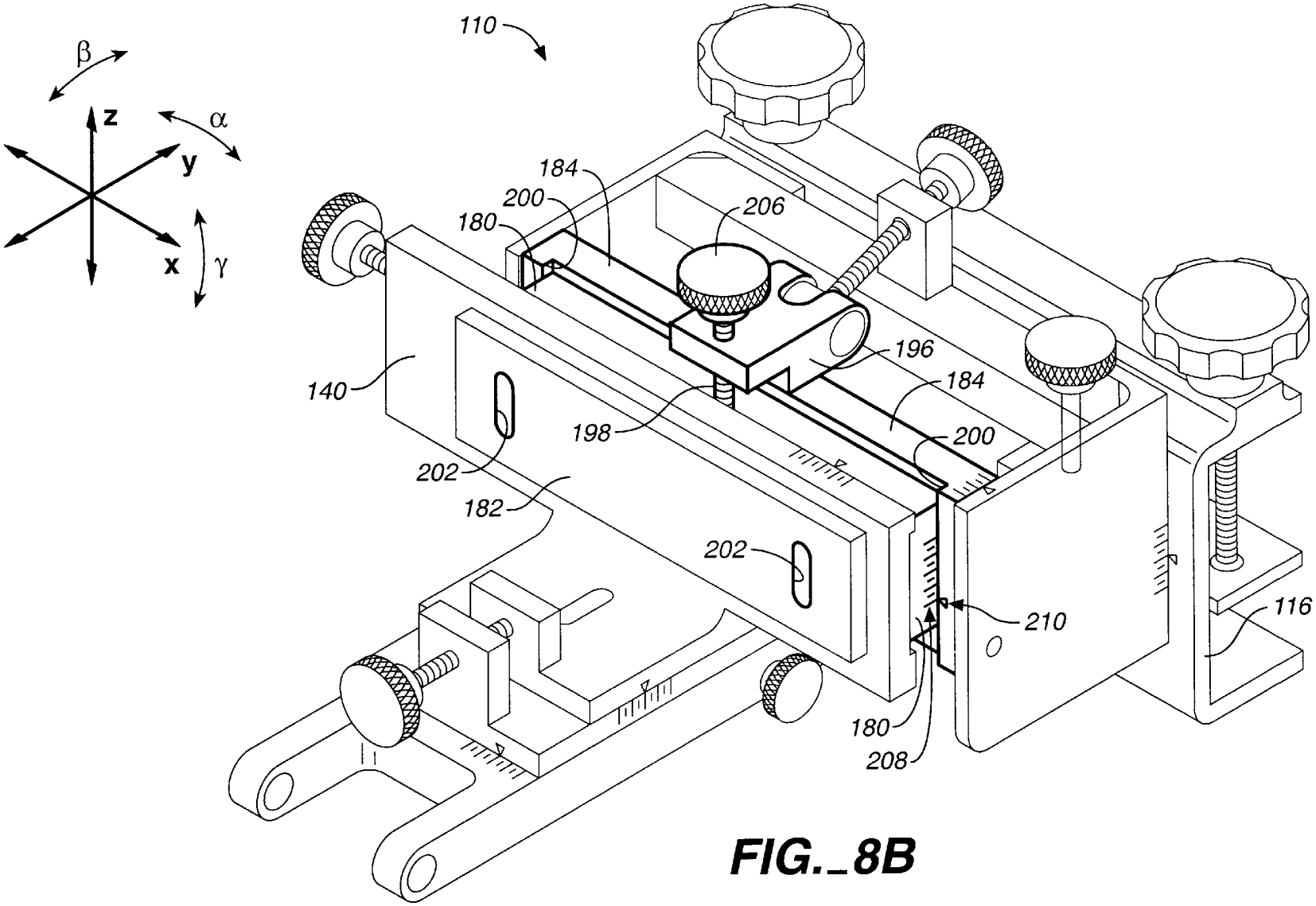

Referring to FIGS. 8A and 8B, press arm 110 further includes an upper mounting bracket 196 rigidly secured to backing plate 184. A vertical threaded bolt 198 is threadably coupled to bracket 196 and is rotatably secured within the top side of block 180. Backing plate 184 includes at each of its ends a shoulder edge 200, which limits backing plate 184 to vertical movement about block 180. In addition, clamp mechanisms 122, 124 (FIG. 4B), which extend through vertical slots 202 in clamp plate 182 and through rectangular slots 204 in plate 140, function to guide vertical movement of backing plate 184. Rotation of knob 206 causes vertical displacement of bracket 196 relative to block 180, which, in turn, raises or lowers clamp support 116, which is secured indirectly to backing plate 184.

A scale 208 on the side of block 180 and indicator mark 210 on the side of shoulder 200 provide an indication of the relative vertical position of the clamp support 116. FIG. 8A shows backing plate 184 fully raised as indicated by the position of indicator mark 210 at the top end of scale 208, and FIG. 8B shows backing plate 184 fully lowered, as indicated by the position of indicator mark 210 at the bottom end of scale 208. Again, vertical adjustment of clamp support 116 is achieved without, at the same time, affecting the tilt of the clamp support or the lateral or angular position of the clamp support.

Figure 9A:
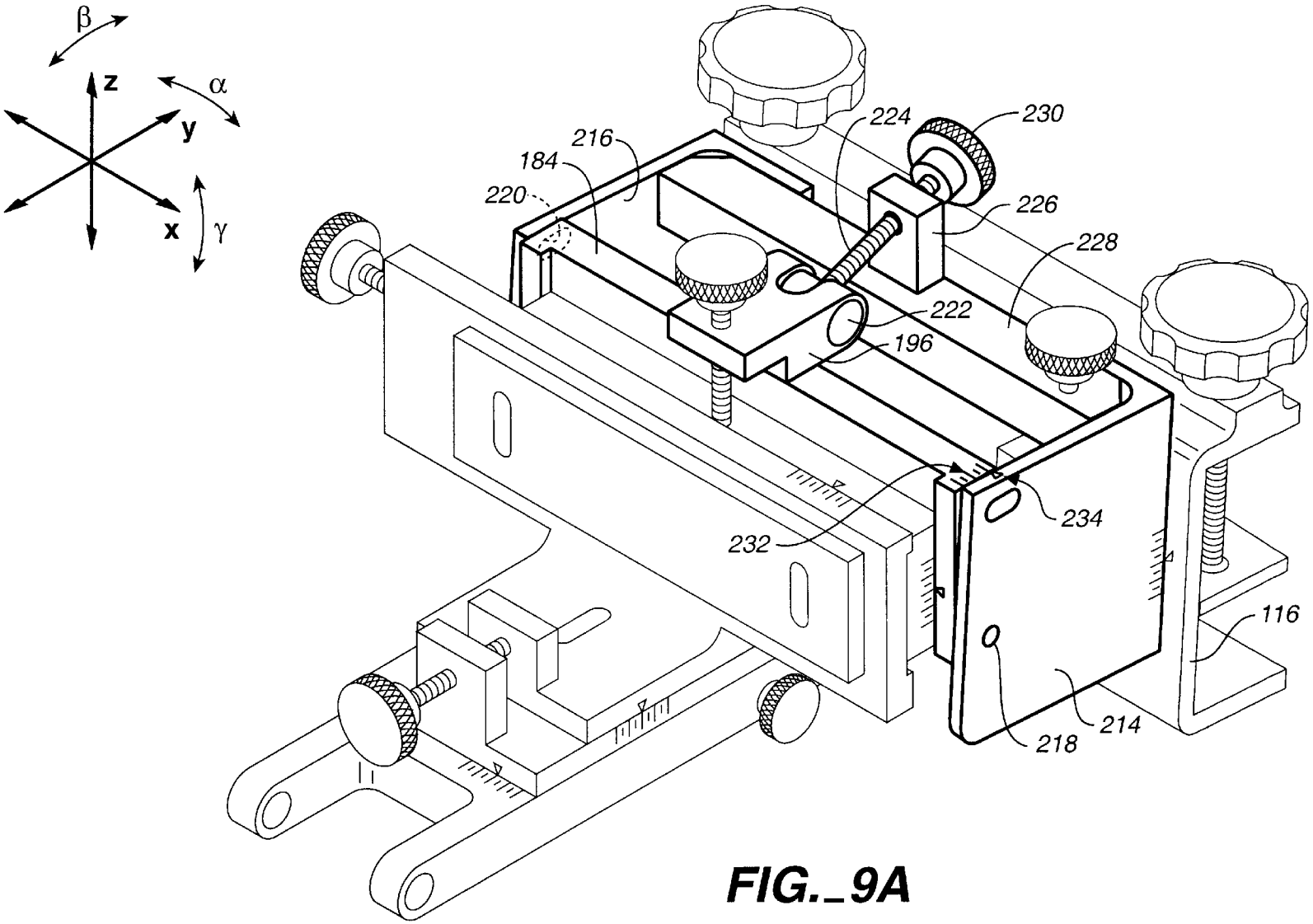
FIGS. 9A and 9B are pictorial views of the components for making a pitch adjustment in the Y-Z plane.
Figure 9B:
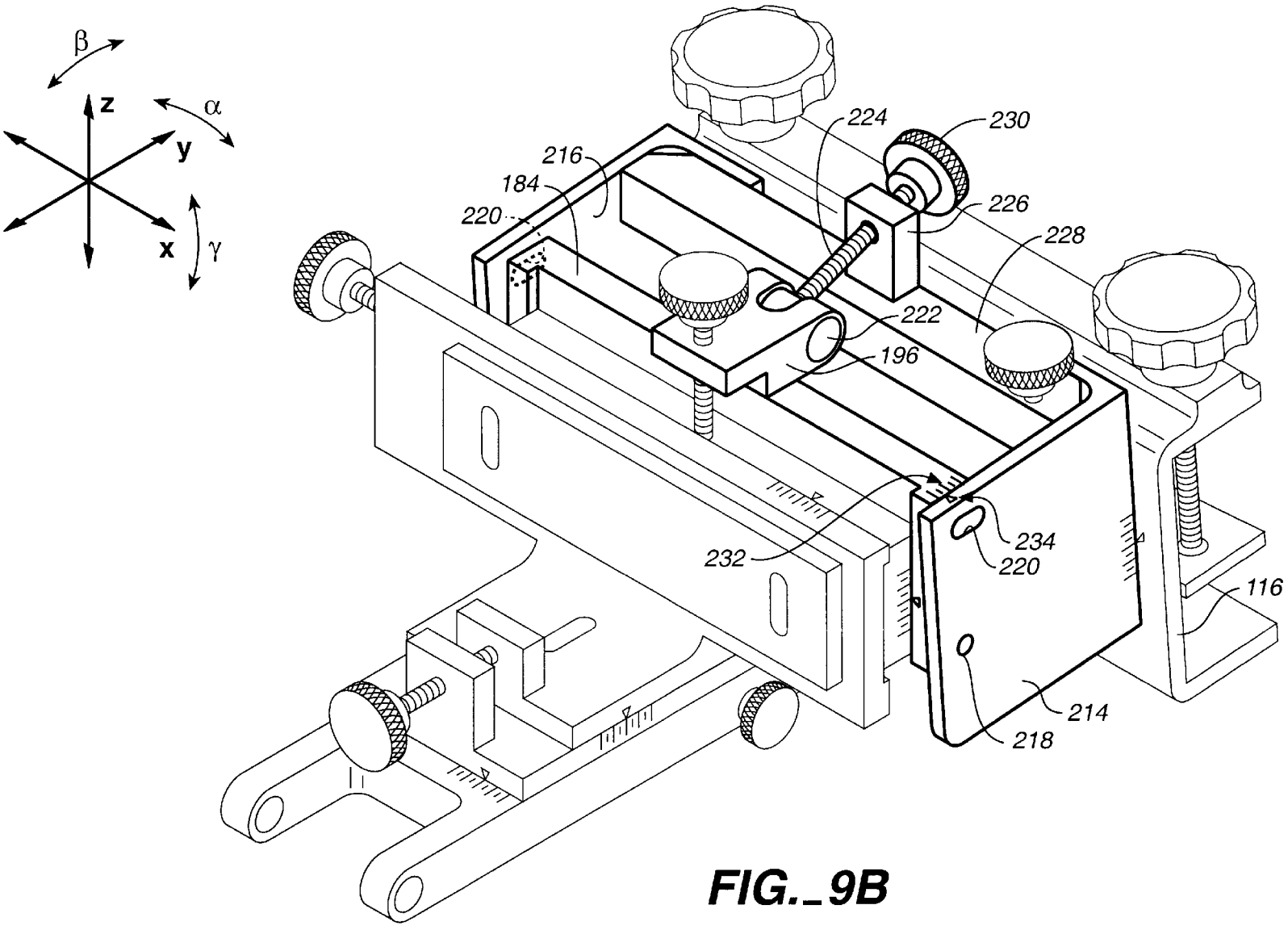

Referring to FIGS. 9A and 9B, press arm 110 further includes a pair of L-shaped side brackets 214, 216 pivotally secured at 218 to the bottom sides of backing plate 184 and releasably clamped by clamp mechanisms positioned within slots 220 to the upper sides of backing plate 184. Slots 220 permit a degree of pivotal movement about pivot 218 of brackets 214, 216 relative to backing plate 184. Clamp support 116 is secured at the front sides of L-shaped brackets 214, 216 in a manner discussed later.

A short pivot link 222 is rotatably journaled within bracket 196. An angled threaded bolt 224 is threadably coupled within pivot link 222 and is rotatably mounted within an upstanding bracket mount 226. Bracket mount 226 is mounted on a transverse bar 228 that is secured between L-shaped side brackets 214, 216. Rotation of knob 230 causes bracket 226 to move toward or away from bracket 196, which causes transverse bar 228 and side brackets 214, 216 to pivot about pivot point 218. This, in turn, pivots clamp support 116 about point 218 and thereby changes the pitch or Y-Z plane adjustment of the clamp support.

Backing plate 184 includes a scale 232 and L-shaped side bracket 214 includes an indicator mark 234. In FIG. 9A, clamp support 116 is pivoted downwardly in the Y-Z plane, which is indicated by mark 234 at the front end of scale 232, and in FIG. 9B, clamp support 116 is pivoted upwardly, which is indicated by mark 234 at the back end of scale 232. Such movement is referred to herein as pitch or angular adjustment in the Y-Z plane. Again, adjustment of the pitch of the clamp support does not affect any of the other adjustments.

Figure 10A:
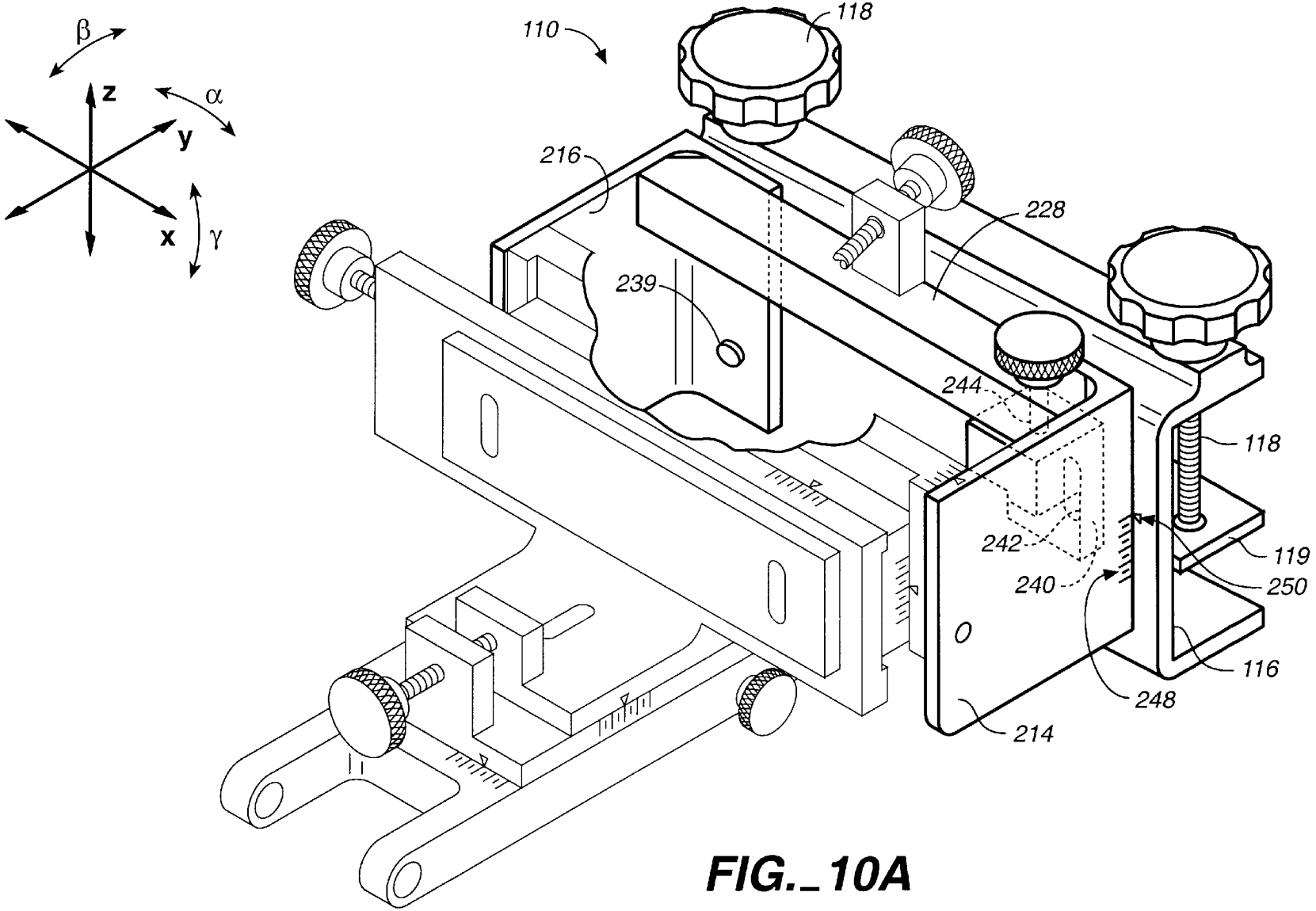
FIGS. 10A and 10B are pictorial views of the components for making a tilt or roll adjustment in the X-Z plane.
Figure 10B:
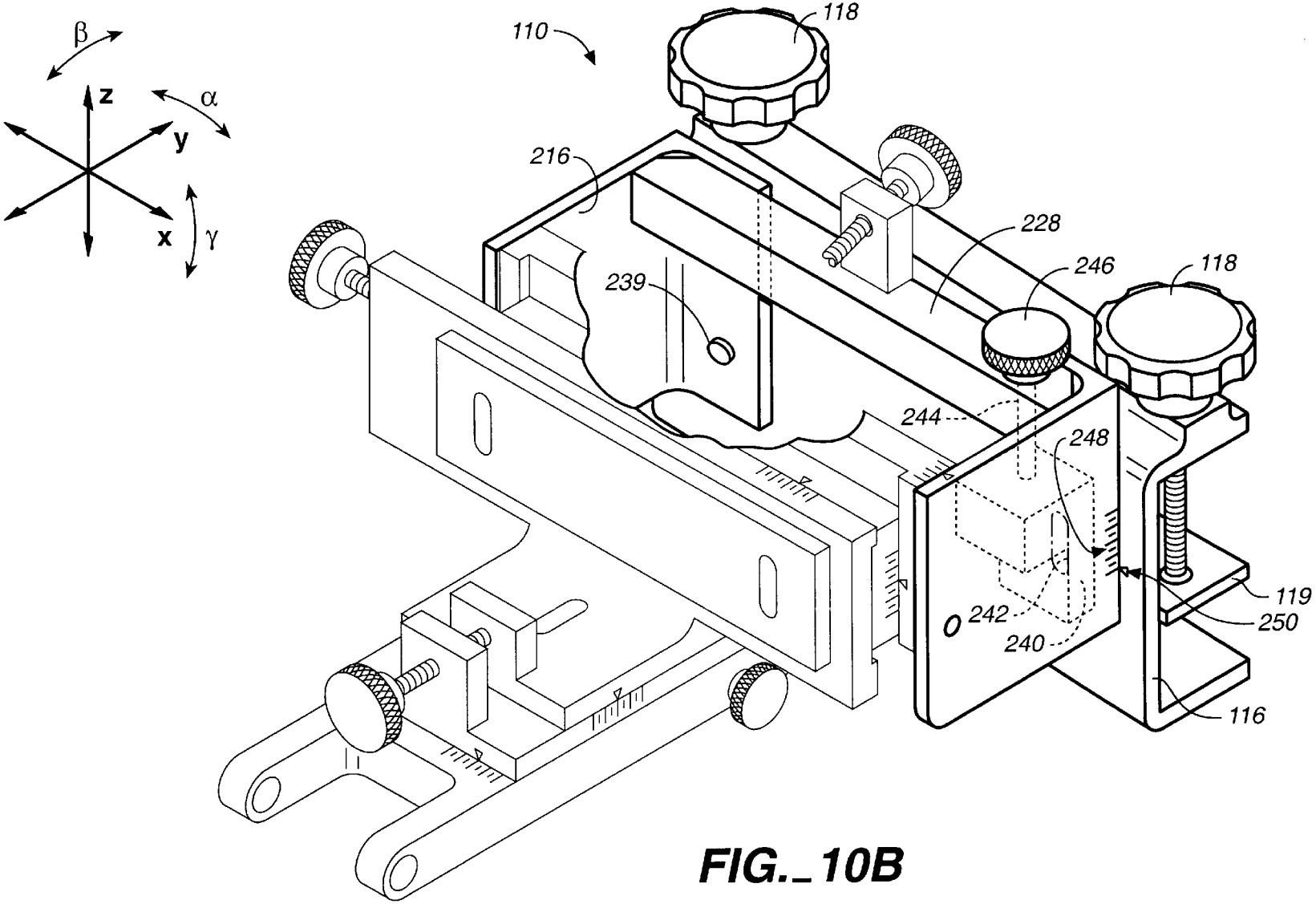

Referring to FIGS. 10A and 10B, press arm 110 further includes a pivot pin 239 that pivotally secures one end of clamp support 116 to L-shaped side bracket 216. At the other end of clamp support 116, an L-shaped mount 240 is secured to clamp support 116 by a clamp mechanism (not shown) that extends through a slot 242 in the front side of L-shaped side bracket 214. A threaded bolt 244 is rotatably mounted through the top side of transverse bar 228 and is threadably coupled within the top side of mount 240.

Rotation of knob 246 moves mount 240 down or up relative to transverse bar 228, which in turn causes clamp support 116 to pivot about pin 239 and slidably move relative to L-shaped side bracket 214, thus producing tilt or angular movement $\gamma$ in the X-Z axis. A scale 248 is provided on side bracket 214 and a cooperating indicator mark 250 is provided on the back side of clamp support 116. FIG. 10A shows clamp support 116 tilted to the left with the near end (as illustrated) of clamp support 116 raised, and FIG. 10B shows clamp support 116 tilted to the right with the near end lowered, both as indicated by mark 250 relative to scale 248. The angular adjustment $\gamma$ in the X-Z plane is independent of the Z-axis adjustment, which is affected by adjustment bolt 198 (See FIG. 8A).

The clamp support is illustrated and described as being adjustable relative to the mounting component both laterally in the X-, Y-, and Z-axis and angularly in the X-Y, Y-Z, and X-Z planes. The particular design of the press arm discussed herein provides for independent adjustment of any one of the following combinations: the Y-axis and X-Y plane adjustments, the Z-axis and X-Z plane adjustments, and the X-axis and Y-axis adjustments. The present invention also comprises combining two or more of these pairs of adjustments to achieve a press arm with multiple independent adjustments.

In the following claims, the term "intermediate components" is used to identify one or more components mounted between the mounting plate and the clamp support, which components provide for independent adjustment of the clamp support. Also, the terms "first", "second", "third" etc. are used to fix a minimum number of intermediate components for certain claims. These numeric terms are not meant to identify any one or more particular intermediate components discussed herein, but rather to identify the relative number of intermediate components provided between the mounting plate and the clamp support. Thus, a particular intermediate component may in one claim be a "first intermediate component" but in another claim be a "second intermediate component," depending on the particular adjustment being claimed.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the Claims appended hereto when read and interpreted according to accepted legal principles such as the doctrine of equivalents and reversal of parts.

The invention claimed is:

1. A press arm assembly for adjustably positioning a printing screen, comprising:

a clamp support for holding the printing screen, and a mounting component adapted for pivotal mounting to a support frame, the mounting component adapted for adjustable mounting of the clamp support, the clamp support being adjustable relative to the mounting component both laterally in the X-, Y-, and Z-axis and angularly in the X-Y, Y-Z, and X-Z planes, with one of the Y-axis and X-Y plane adjustments, the Z-axis and X-Z plane adjustments, and the X-axis and Y-axis adjustments being independent of the other.

2. The press arm assembly of claim 1 wherein, the Y-axis and X-Y plane adjustments are independent of each other and further comprising a first intermediate component adjustably secured to the mounting component and independently, adjustably secured to the clamp support to provide independent adjustment of the clamp support laterally in the Y-axis and angularly in the X-Y plane.

3. The press arm assembly of claim 2 wherein, the mounting component and the first intermediate component include a calibration scale and cooperating indicator for precise adjustment in the Y-axis.

4. The press arm assembly of claim 2 wherein, the clamp support and the first intermediate component include a calibration scale and cooperating indicator for precise adjustment in the X-Y plane.

5. The press arm assembly of claim 2 and further including a threaded bolt and cooperating threaded nut for providing lateral adjustment in the Y-axis.

6. The press arm assembly of claim 5 wherein, the threaded bolt is rotatably secured to the clamp support and the threaded nut is secured to the first intermediate component.

7. The press arm assembly of claim 2 and further including a first threaded bolt and cooperating threaded nut for providing angular adjustment in the X-Y plane.

8. The press arm assembly of claim 7 and further including a second threaded bolt for providing angular adjustment in the X-Y plane, the first and second threaded bolts rotatably positioned on opposite sides of the first intermediate component, to engage and pivot the first intermediate component.

9. The press arm assembly of claim 2 wherein, the Z-axis and X-Z plane adjustments are independent of each other and further comprising a second intermediate component adjustably secured to the first intermediate component and independently, adjustably secured to one of the clamp support and mounting component to provide independent adjustment of the clamp support laterally in the Z-axis and angularly in the X-Z plane.

10. The press arm assembly of claim 9 and further comprising, additional intermediate components adjustably secured to the first and second intermediate components to provide adjustment in the X-axis and the Y-Z plane.

11. The press arm assembly of claim 10 and wherein, the X-axis and Y-axis adjustments are independent of one another.

12. The press arm assembly of claim 1 wherein, the Z-axis and X-Z plane adjustments are independent of each other and further comprising a first intermediate component adjustably secured to the mounting component and independently, adjustably secured to the clamp support to provide independent adjustment of the clamp support laterally in the Z-axis and angularly in the X-Z plane.

13. The press arm of claim 12 wherein, the mounting component and the first intermediate component include a calibration scale and cooperating indicator for precise adjustment in the Z-axis.

14. The press arm assembly of claim 12 wherein, the clamp support and the first intermediate component include a calibration scale and cooperating indicator for precise adjustment in the X-Z plane.

15. The press arm assembly of claim 12 and further including a threaded bolt and a cooperating threaded nut for providing lateral adjustment in the Z-axis.

16. The press arm assembly of claim 15 wherein, the threaded bolt is rotatably secured to the first intermediate component and the threaded nut is secured to the mounting component.

17. The press arm assembly of claim 12 and further including a threaded bolt and a cooperating threaded nut for providing angular adjustment in the X-Z plane.

18. The press arm assembly of claim 17 wherein, the threaded bolt is rotatably secured to the first intermediate component and the threaded nut is secured to the clamp support.

19. The press arm assembly of claim 12 wherein, the Y-axis and X-Y plane adjustments are independent of each other and further comprising a second intermediate component adjustably secured to the first intermediate component and independently, adjustably secured to one of the clamp support and the mounting component to provide independent adjustment of the clamp support laterally in the X-axis and angularly in the X-Y plane.

20. The press arm assembly of claim 19 and wherein, the X-axis and Y-axis adjustments are independent of one another.

21. The press arm assembly of claim 20 and further comprising, additional intermediate components adjustably secured to the first and second intermediate components to provide adjustment in the X-axis and the Y-Z plane.

22. The press arm assembly of claim 1 wherein, the X-axis and Y-axis adjustments are independent of one another and further comprising a first intermediate component adjustably secured to mounting component and independently, adjustably secured to the clamp support to provide independent adjustment in the X-axis and Y-axis.

23. The press arm assembly of claim 22 wherein the clamp support, the mounting component and the first intermediate component include calibration scales and cooperating indicators to provide precise adjustment in the X-axis and Y-axis.

24. The press arm assembly of claim 23 wherein, the Z-axis and X-Z plane adjustments are independent of each other and further comprising a second intermediate component adjustably secured to the first intermediate component and independently, adjustably secured to one of the clamp support and mounting component to provide independent adjustment of the clamp support laterally in the Z-axis and angularly in the X-Z plane.

25. The press arm assembly of claim 24 wherein, the Y-axis and X-Y plane adjustments are independent of each other and further comprising a third intermediate component adjustably secured to one of the first and second intermediate components and independently, adjustably secured to one of the other of the first and second intermediate components, the clamp support and the mounting component to provide independent adjustment of the clamp laterally in the X-axis and angularly in the X-Y plane.

* * * * *